US010080438B2

(12) United States Patent
Paul et al.

(10) Patent No.: US 10,080,438 B2
(45) Date of Patent: Sep. 25, 2018

(54) PATIENT SUPPORT APPARATUS

(71) Applicant: Stryker Corporation, Kalamazoo, MI (US)

(72) Inventors: Anish Paul, Portage, MI (US); Matthew A. Cutler, Portage, MI (US); Kaitlin Therese Konopacz, Portage, MI (US); Christopher Stuart Hough, Kalamazoo, MI (US); Joseph Adam Upchurch, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 48 days.

(21) Appl. No.: 15/267,493

(22) Filed: Sep. 16, 2016

(65) Prior Publication Data

US 2017/0079434 A1 Mar. 23, 2017

Related U.S. Application Data

(60) Provisional application No. 62/249,539, filed on Nov. 2, 2015, provisional application No. 62/221,164, filed on Sep. 21, 2015.

(51) Int. Cl.
*A47C 1/03* (2006.01)
*A47C 1/024* (2006.01)
(Continued)

(52) U.S. Cl.
CPC ..... *A47C 1/03* (2013.01); *A47C 1/024* (2013.01); *A47C 3/20* (2013.01); *A47C 7/006* (2013.01);
(Continued)

(58) Field of Classification Search
CPC .. A47C 1/03; A47C 1/024; A47C 3/20; A47C 7/006; A47C 7/506; A47C 7/54;
(Continued)

(56) References Cited

U.S. PATENT DOCUMENTS 2,620,020 A 12/1952 Austin
2,869,623 A 1/1959 Poulin
(Continued)

FOREIGN PATENT DOCUMENTS

JP 7-8521 A2 1/1995
WO 2012176738 A1 12/2012

OTHER PUBLICATIONS

European Search Report dated Jan. 13, 2017, for European application EP 16189514, corresponding to U.S. Appl. No. 15/267,493.

*Primary Examiner* — Philip F Gabler
(74) *Attorney, Agent, or Firm* — Warner Norcross + Judd LLP

(57) ABSTRACT

A patient support apparatus including a seat section, a backrest section that is movable relative to the seat section, and an arm supported relative to the seat section. The arm is adapted to move between a first position adjacent the seat section for use as an arm rest for a person sitting on the patient support apparatus to a raised second position adjacent the backrest section. The arm and the backrest section are coupled together when the arm is in the raised second position wherein the arm moves with the backrest section.

24 Claims, 31 Drawing Sheets

(51) Int. Cl.

| | |
|---|---|
| ***A47C 3/20*** | (2006.01) |
| ***A47C 7/00*** | (2006.01) |
| ***A47C 7/50*** | (2006.01) |
| ***A47C 7/54*** | (2006.01) |
| ***A61G 5/14*** | (2006.01) |
| ***A61G 5/00*** | (2006.01) |
| ***A61G 5/10*** | (2006.01) |
| ***A61G 15/02*** | (2006.01) |
| ***A61G 5/12*** | (2006.01) |
| *A61G 15/12* | (2006.01) |

(52) U.S. Cl.
CPC ..... *A47C 7/506* (2013.01); *A47C 7/54* (2013.01); *A61G 5/006* (2013.01); *A61G 5/1067* (2013.01); *A61G 5/125* (2016.11); *A61G 5/14* (2013.01); *A61G 15/02* (2013.01); *A61G 15/12* (2013.01)

(58) Field of Classification Search
CPC ..... A61G 5/125; A61G 5/006; A61G 5/1067; A61G 5/14; A61G 15/02; A61G 15/12
See application file for complete search history.

(56) References Cited

U.S. PATENT DOCUMENTS

| | | | | |
|---|---|---|---|---|
| 3,578,379 | A | 5/1971 | Taylor et al. | |
| 3,661,421 | A * | 5/1972 | Johnson | A47C 1/03 297/411.32 |
| 4,231,614 | A | 11/1980 | Shaffer | |
| 4,466,664 | A | 8/1984 | Kondou | |
| 4,707,026 | A | 11/1987 | Johansson | |
| 4,974,905 | A | 12/1990 | Davis | |
| 5,112,076 | A | 5/1992 | Wilson | |
| 5,242,138 | A | 9/1993 | Kornberg | |
| 5,382,079 | A * | 1/1995 | Wilson | A47C 1/03 297/411.35 |
| 5,415,459 | A | 5/1995 | Schultz | |
| 5,419,571 | A | 5/1995 | Vaughan | |
| 5,547,245 | A | 8/1996 | Knouse | |
| 5,733,010 | A | 3/1998 | Lewis et al. | |
| 5,836,645 | A | 11/1998 | Sakaue et al. | |
| 5,984,416 | A | 11/1999 | Waldo et al. | |
| 6,053,578 | A | 4/2000 | van Hekken et al. | |
| 6,089,593 | A * | 7/2000 | Hanson | A61G 5/006 280/250.1 |
| 6,106,070 | A | 8/2000 | Ritt et al. | |
| 6,185,769 | B1 | 2/2001 | Larisey, Jr. et al. | |
| 6,203,101 | B1 | 3/2001 | Chou et al. | |
| D439,869 | S | 4/2001 | Kjell et al. | |
| 6,296,313 | B1 | 10/2001 | Wu | |
| 6,315,319 | B1 | 11/2001 | Hanson et al. | |
| 6,343,839 | B1 * | 2/2002 | Simons, Jr. | A47C 7/54 297/411.2 |
| 6,352,307 | B1 | 3/2002 | Engman | |
| 6,565,112 | B2 | 5/2003 | Hanson et al. | |
| 6,572,195 | B1 | 6/2003 | Lee | |
| 6,585,206 | B2 | 7/2003 | Metz et al. | |
| 6,659,560 | B1 | 12/2003 | Chi | |
| 6,692,069 | B2 | 2/2004 | Beroth et al. | |
| 6,792,633 | B1 | 9/2004 | Ito | |
| 6,846,042 | B2 | 1/2005 | Hanson et al. | |
| 6,883,871 | B2 | 4/2005 | Nae et al. | |
| 7,144,067 | B2 | 12/2006 | Gramss | |
| 7,185,952 | B1 | 3/2007 | Chen et al. | |
| 7,243,997 | B1 | 7/2007 | Tornero | |
| 7,384,102 | B2 | 6/2008 | Chen et al. | |
| 7,387,342 | B1 | 6/2008 | Clough et al. | |
| 7,404,567 | B2 | 7/2008 | Moller | |
| 7,422,288 | B2 * | 9/2008 | Ahearn | A61G 15/12 297/227 |
| 7,527,335 | B2 | 5/2009 | Eberlein et al. | |
| 7,537,268 | B2 | 5/2009 | Becker et al. | |
| 7,618,095 | B2 | 11/2009 | Nielsen | |
| 7,676,862 | B2 | 3/2010 | Poulos et al. | |
| 7,832,805 | B1 | 11/2010 | Lai | |
| 7,862,123 | B2 | 1/2011 | Baker et al. | |
| 7,988,171 | B2 | 8/2011 | Chong | |
| 8,056,160 | B2 | 11/2011 | Poulos et al. | |
| 8,403,418 | B2 | 3/2013 | Lindell | |
| 8,480,172 | B2 | 7/2013 | Baker et al. | |
| 8,662,594 | B2 | 3/2014 | Faccin | |
| 8,919,797 | B2 | 12/2014 | Lowenthal et al. | |
| 8,944,512 | B2 | 2/2015 | Girbinger et al. | |
| 9,084,710 | B2 | 7/2015 | Paul et al. | |
| 9,301,895 | B2 | 4/2016 | Hough et al. | |
| 2005/0046129 | A1 | 3/2005 | Antonishak et al. | |
| 2006/0261659 | A1 | 11/2006 | Dykes | |
| 2008/0111338 | A1 | 5/2008 | Ilan | |
| 2010/0025969 | A1 | 2/2010 | Kent et al. | |
| 2010/0123346 | A1 | 5/2010 | Lin | |
| 2010/0141002 | A1 | 6/2010 | Kurrasch et al. | |
| 2011/0175329 | A1 | 7/2011 | Gingras et al. | |
| 2011/0227314 | A1 | 9/2011 | Lowenthal et al. | |
| 2011/0236130 | A1 | 9/2011 | Klein et al. | |
| 2012/0074751 | A1 | 3/2012 | De La Garza et al. | |
| 2012/0292883 | A1 | 11/2012 | Noonan et al. | |
| 2013/0026737 | A1 | 1/2013 | Pizzi Spadoni | |
| 2014/0125107 | A1 | 5/2014 | Cha et al. | |
| 2014/0159461 | A1 | 6/2014 | Mochizuki et al. | |
| 2014/0225414 | A1 | 8/2014 | Faccin | |

* cited by examiner

PATIENT SUPPORT APPARATUS

This application claims the benefit of U.S. provisional application Ser. No. 62/249,539, filed on Nov. 2, 2015, entitled PATIENT SUPPORT APPARATUS, by Applicant Stryker Corporation and of U.S. provisional application Ser. No. 62/221,164, filed on Sep. 21, 2015, entitled PATIENT SUPPORT APPARATUS, by Applicant Stryker Corporation, which are incorporated by reference herein in their entireties.

TECHNICAL FIELD

The present disclosure relates to a patient support apparatus, and more particularly to a medical recliner chair with an articulatable arm that forms an armrest.

SUMMARY OF THE DESCRIPTION

The present disclosure is directed to a patient support apparatus with an articulatable arm that forms an armrest for a person seated in the patient support apparatus when the patient support apparatus in seated position or a reclined position, but which is able to move completely out of the way, for example, when the patient support apparatus is in a flat position to facilitate a lateral transfer of a patient off the apparatus.

In one embodiment, a patient support apparatus includes a seat section and a backrest section, which is movable relative to the seat section. An arm is supported relative to the seat section and is adapted to move between an armrest position adjacent the seat section for use as an armrest for a person that is seated on the patient support apparatus to a raised position adjacent the backrest section. The arm and the backrest section are coupled together when the arm is in the raised position wherein the arm moves with the backrest section when the arm is in the raised position and the backrest section is moved to a reclined position.

In one embodiment, the arm and the backrest section are selectively releasably coupled together when the arm is in the raised position.

In another embodiment, the backrest section includes stop, such as a hook, for coupling the arm to the back rest.

In yet another embodiment, the patient support apparatus further includes a chassis frame that supports the seat section and the backrest section. Optionally, the arm is pivotally mounted to the chassis frame.

According to yet another embodiment, the patient support apparatus further includes a stationary member mounted to the chassis frame, with the arm rotatably mounted about the stationary member to pivotally mount the arm to the chassis frame.

In another embodiment, the arm includes an arm frame that includes a pivot member. The pivot member of the arm frame rotatably mounts the arm about the stationary member of the chassis frame.

In yet another embodiment, the patient support apparatus further includes a locking mechanism for locking the arm in the armrest position. For example, the locking mechanism may include a plunger.

In another embodiment, the patient support apparatus further includes a chassis frame that supports the seat section. The chassis frame supports a stationary member with the arm rotatably mounted about the stationary member to pivotally mount the arm to the chassis frame, and where the plunger selectively engages the stationary member to lock the arm in position.

In yet another embodiment, the arm includes an arm frame and a pivot member that rotatably mounts the arm frame about the stationary member of the chassis frame. A plunger is mounted in the pivot member of the arm frame for selective engagement of the stationary member of the chassis frame.

According to yet another embodiment, the patient support apparatus further includes a release mechanism, such as a handle, to selectively release the locking mechanism. For example, the handle may be mounted to the arm frame.

In another embodiment, the patient support apparatus further includes an arm frame that forms the arm, and the arm frame is selectively coupled to the backrest section.

According to another embodiment, a patient support apparatus includes a seat section, a backrest section that is movable relative to the seat section, an arm supported relative to the seat section that is pivotally mounted adjacent the seat section about a range of motion for use as an armrest for a person seated on the patient support apparatus, and a locking mechanism configured to selectively lock the arm in an armrest position adjacent the seat section and to selectively unlock the arm from its armrest position to allow the arm to move between multiple unlocked raised positions.

In one embodiment, the backrest section is configured to tilt relative to the seat section between a first angle and a second angle. A first raised unlocked position of multiple unlocked raised positions of the arm generally aligns the arm with the backrest section when the backrest section is at the first angle, and a second raised unlocked position of the multiple unlocked raised positions of the arm generally aligns the arm with the backrest section when the backrest section is tilted to the second angle.

In another embodiment, the patient support apparatus further includes a chassis frame that supports the seat section and the backrest section, with the arm pivotally mounted to the chassis frame.

For example, the arm and the backrest section may be selectively releasably coupled together when the arm is in the first raised position.

In yet another embodiment, the patient support apparatus further includes a stationary member mounted to the chassis frame. The arm is rotatably mounted about the stationary member to pivotally mount the arm to the chassis frame between the armrest position and the raised positions. The stationary member has a notch, and the locking mechanism includes a plunger that selectively engages a notch in the stationary member to lock the position of the arm in the armrest position and that is selectively removed from the notch to allow the arm to move between the first raised position and the second raised position, with the second and second raised positions defined by the backrest section.

For example, the arm may include an arm frame that includes a pivot member that rotatably mounts the arm about the stationary member of the chassis frame, with the plunger mounted in the pivot member of the arm frame.

According to yet another embodiment, a patient support apparatus includes a seat section, a backrest section that is movable relative to the seat section, an arm supported relative to the seat section that is pivotally mounted adjacent the seat section by a pivot connection about a range of motion for use as an armrest for a person seated on the patient support apparatus. The pivot connection includes a cable pathway there through to allow a cable to extend through the pivot connection.

In one embodiment, the patient support apparatus further includes a chassis frame, with the seat section and the backrest section mounted to the chassis frame.

In another embodiment, the pivot connection comprises a stationary member mounted to the chassis frame, with the arm being rotatably mounted about the stationary member to pivotally mount the arm to the chassis frame between an armrest position and a raised position.

For example, the pivot connection may further include a pivot member mounted to the arm, the pivot member of the arm mounted to the stationary member, which is mounted to the chassis frame, wherein each of the pivot member and the stationary member includes a slot extending there through, and wherein the slots overlap over a range of motion of the pivot connection to thereby form the cable pathway there through over the range of motion.

Optionally, the pivot connection further includes a guard to prevent pinching of the cable between two or more components of the patient support apparatus when the arm is pivoted about its pivot axis.

In another embodiment, the pivot connection includes a stationary member and a pivot member mounted about the stationary member, with each of the pivot member and the stationary member including a slot extending there through, and wherein the slots overlap over the operative range of motion of the pivot connection to thereby form the cable pathway there through.

In a further embodiment, the patient support apparatus further includes a chassis frame, with the stationary member mounted to the chassis frame.

In another embodiment, a patient support apparatus comprises a stationary member, a pivot member, which is rotationally mounted about the stationary member, a first locking component, and a second locking component. The first and second locking components are for coupling together to lock rotational movement between the stationary member and the pivot member when the first and second locking components are aligned. The patient support apparatus further comprises an adjustment mechanism configured for fine-tuned alignment of the first locking component with the second locking component after the first and second locking components are at least nearly aligned and thereby reduce slop.

In one aspect, the adjustment mechanism is configured to provide unidirectional adjustment to the first locking component or the second locking component.

In another aspect, the adjustment mechanism is configured to provide to provide bidirectional adjustment to the first locking component or the second locking component.

For example, the adjustment mechanism may comprise a set screw.

In further aspects, the adjustment mechanism further comprises a first stop fixed relative to the stationary member and a second stop fixed relative the pivot member.

In yet a further aspect, the set screw is mounted to the first stop or the second stop.

In one embodiment, the patient support apparatus further comprises an arm and a chassis frame supporting the arm. The pivot member or the stationary member is fixed relative to the chassis frame, and the other of the pivot member and the stationary member is mounted to the arm.

In a further embodiment, the first locking component comprises a notch in the pivot member or the stationary member, and the second locking component is mounted to the other of the pivot member and the stationary member and is operable to extend into the notch and to define gaps between the second locking component and the opposed sides of the notch. The adjustment mechanism is configured to adjust the gaps between the second locking component and the opposed sides of the notch to fine-tune alignment of the pivot member with the stationary member to thereby reduce slop.

In yet another embodiment, the adjustment mechanism is further configured to initially align the second locking component with the notch before the second locking component extends into the notch.

In one embodiment, the adjustment mechanism comprises a set screw.

According to yet another embodiment, a method of mounting a pivot member to a fixed member, where the fixed member has a first locking component and the stationary member has a second locking component, which couple together to lock rotational movement between the stationary member and the pivot member when the first and second locking components are aligned, includes rotationally mounting the pivot member about the fixed member. Once mounted, the first locking component is at least nearly aligned with the second locking component. The alignment of the first locking component with the second locking component is then adjusted to fine-tune the alignment of the first locking component with the second locking to thereby reduce slop.

In one aspect, the adjusting comprises adjusting gaps between the first locking component and the second locking component.

In another aspect, the adjusting comprises adjusting one gap of the gaps to a dimension smaller than that of another gap of the gaps.

In yet another aspect, the adjusting comprises adjusting the gaps so that they are substantially equal.

According to another embodiment, a method of mounting an arm on a recliner with a seat section and a tiltable backrest section includes pivotally mounting the arm to the recliner, and selectively locking the arm in an armrest position adjacent the seat section. The method further includes providing a stop for selectively coupling the arm, when unlocked from the armrest position, to the backrest section so that when the arm is pivoted to a raised position adjacent the backrest section and the backrest section is moved to a reclined position away from the seat section, the arm moves with the backrest section.

In yet another embodiment, a patient support apparatus includes a seat section and an arm supported relative to the seat section. The arm is pivotally mounted adjacent the seat section, and the arm is pivotally mounted at the patient support apparatus about a pivot axis by a pivot connection. The pivot connection is configured to allow a controlled fall of the arm about the pivot axis but is biased to provide a tight engagement at the pivot connection.

In one aspect, the pivot connection includes a stationary member mounted to the patient support apparatus and a pivot member mounted about the stationary member. The pivot connection is configured to urge the pivot member with sufficient force into tight engagement with the stationary member but to allow the arm to pivot about the pivot axis.

In a further aspect, the pivot connection includes a thrust bearing. For example, the thrust bearing may include two friction discs.

In yet a further aspect, the arm forms an arm rest.

In another aspect, the arm comprises a mounting arm for a side rail.

According to yet another embodiment, a patient support apparatus includes a seat section, a pivotal backrest section, a chassis frame supporting the seat section and the backrest section, and the backrest section and the seat section supported to tilt relative to the chassis frame. The apparatus further includes a base adapted to support the chassis frame on and to raise the chassis frame relative a floor surface, and an arm supported by the chassis frame, with the arm having an upper surface forming an arm rest. The upper surface has an orientation relative to the floor surface, and with the orientation of the arm rest remaining generally constant when the backrest section is tilted, when the seat section is tilted, or when the chassis frame is raised relative to the floor so as to provide a stable surface for a person seated in the apparatus and when the person is exiting the apparatus.

In one aspect, the upper surface is curved and has one or more curved regions.

In a further aspect, the arm is mounted to the chassis frame.

In other aspects, the arm includes a cushioning material to form the upper surface, with the cushioning material optionally comprising a biocompatible material, such as a thermoplastic elastomer or a urethane foam.

In yet another embodiment, a method of using an arm on a recliner chair, with the recliner chair having a seat section and a tiltable backrest section, includes pivotally mounting the arm to the recliner, selectively locking the arm in an armrest position adjacent the seat section, when unlocked from the armrest position, selectively pivoting the arm to a raised position adjacent the backrest section, and, when the backrest section is tilted away from the seat section, coupling the arm to the backrest section wherein the arm moves with the backrest section.

In yet another embodiment, a patient support apparatus includes a seat section and an arm supported relative to the seat section, with the arm being pivotally mounted adjacent the seat section. Further, the arm is pivotally mounted at the patient support apparatus about a pivot axis by a pivot connection, with the pivot connection configured to allow a free fall or a controlled fall of the arm about the pivot axis, but which is biased to provide a tight engagement at the pivot connection and thereby reduce slop.

In one aspect, the pivot connection includes a stationary member mounted to the patient support apparatus and a pivot member mounted about the stationary member, and the pivot connection is configured to urge the pivot member with sufficient force into tight engagement with the stationary member but to allow the arm to pivot about the pivot axis.

For example, the pivot connection may include a thrust bearing.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

BRIEF DESCRIPTION OF THE DRAWINGS

FIG. 13 is an enlarged cross-section view taken through the pivot connection of the arm mounting assembly illustrating a cable pathway there through;

DESCRIPTION

Figure 1:
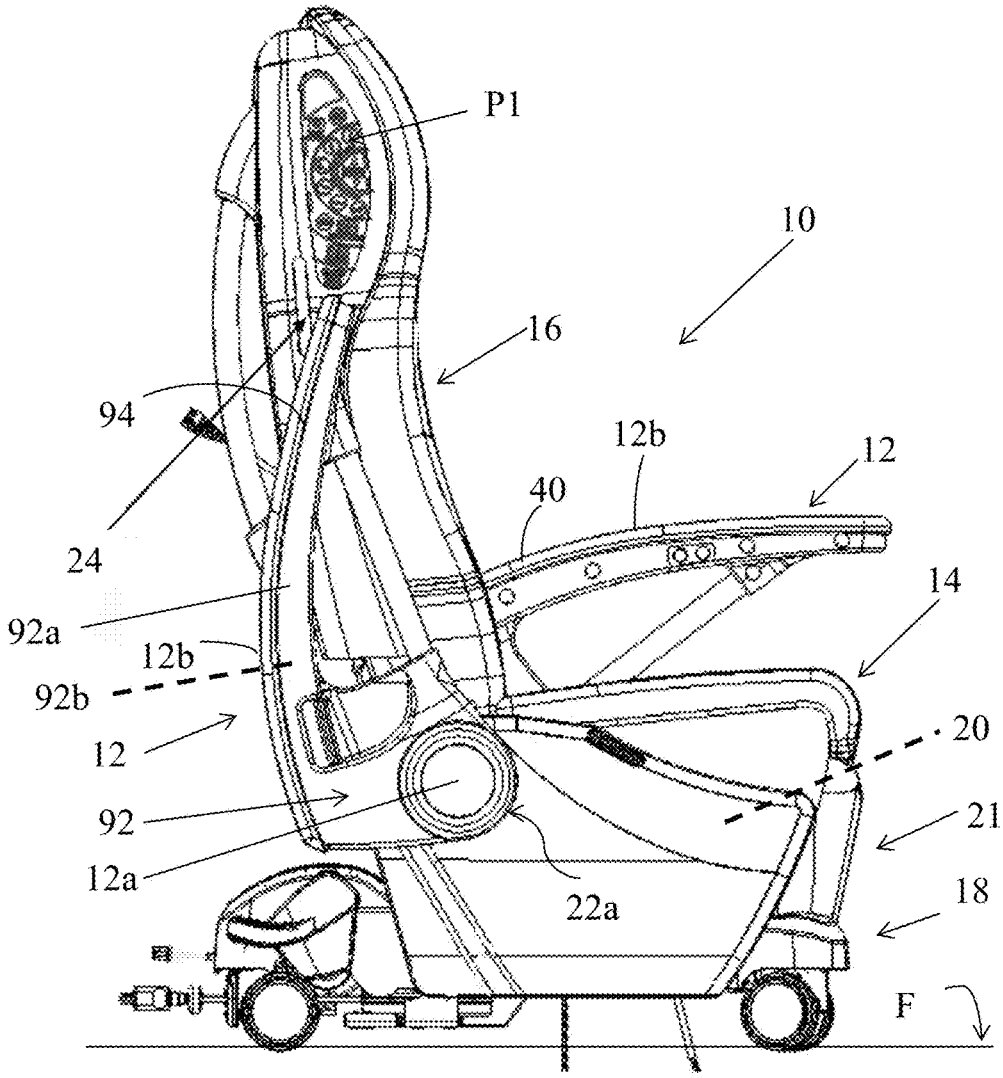
FIG. 1 is a side elevation view of a patient support apparatus in the form of a medical recliner chair in a seated orientation, with the closest arm in a raised position adjacent the backrest section of the chair.

Referring to FIG. 1, the numeral 10 generally designates a patient support apparatus. In the illustrated embodiment, patient support apparatus 10 is shown in the form of a medical recliner chair, which is adapted to be reconfigured between a seated configuration, such as shown in FIG. 1, and one or more reclined positions, including a fully reclined, a flat position, such as shown partially in FIG. 3, or a Trend position, i.e. the head end of the backrest section is lower than the foot end of the chair. Further, the chair can be arranged to facilitate transfer of a patient off the chair. As will be more fully described below, patient support apparatus 10 includes an arm 12 for use as an armrest for a person sitting in the patient support apparatus. Arm 12 is adapted to move between a locked armrest position adjacent a seat section 14 of patient support apparatus 10 and one or more raised positions, such as a position where arm 12 is adjacent a backrest section 16 of patient support apparatus 10 so that a person may be laterally transferred off patient support apparatus 10 while in a seated position or simply to provide access to a person seated on apparatus 10. Furthermore, arm 12 is configured to move with the backrest section 16 when the backrest section 16 is moved from a first angle in which the backrest section 16 forms the seated configuration and a second angle in which the backrest section 16 is reclined or lowered (moved in a counterclockwise as viewed in FIG. 1), for example, to a reclined position (FIG. 1A), a flat position (FIG. 3), or a Trend position (not shown) so that the arm can be moved out of the way entirely to provide access to a patient supported on patient support apparatus 10 or to allow a lateral transfer of a patient off patient support apparatus 10 when the backrest section 16 is in any position, including a sitting position, a reclined position, a flat position, or a Trend position.

Referring again to FIG. 1, in the illustrated embodiment, patient support apparatus 10 includes a base 18. Optionally, base 18 comprises a wheeled base with a plurality of casters, which allows apparatus 10 to be moved across a transport surface, such as a floor F of a medical facility. For further details of a suitable base and further an optional control system and control panels, reference is made herein to U.S. patent application Ser. No. 14/801,167 filed Jul. 16, 2015; Ser. No. 14/212,253 filed Mar. 14, 2014, and Ser. No. 14/282,383 filed May 20, 2014, which are commonly owned by Stryker Corporation of Kalamazoo Mich. and incorporated by reference in their entireties herein.

Figure 1A:
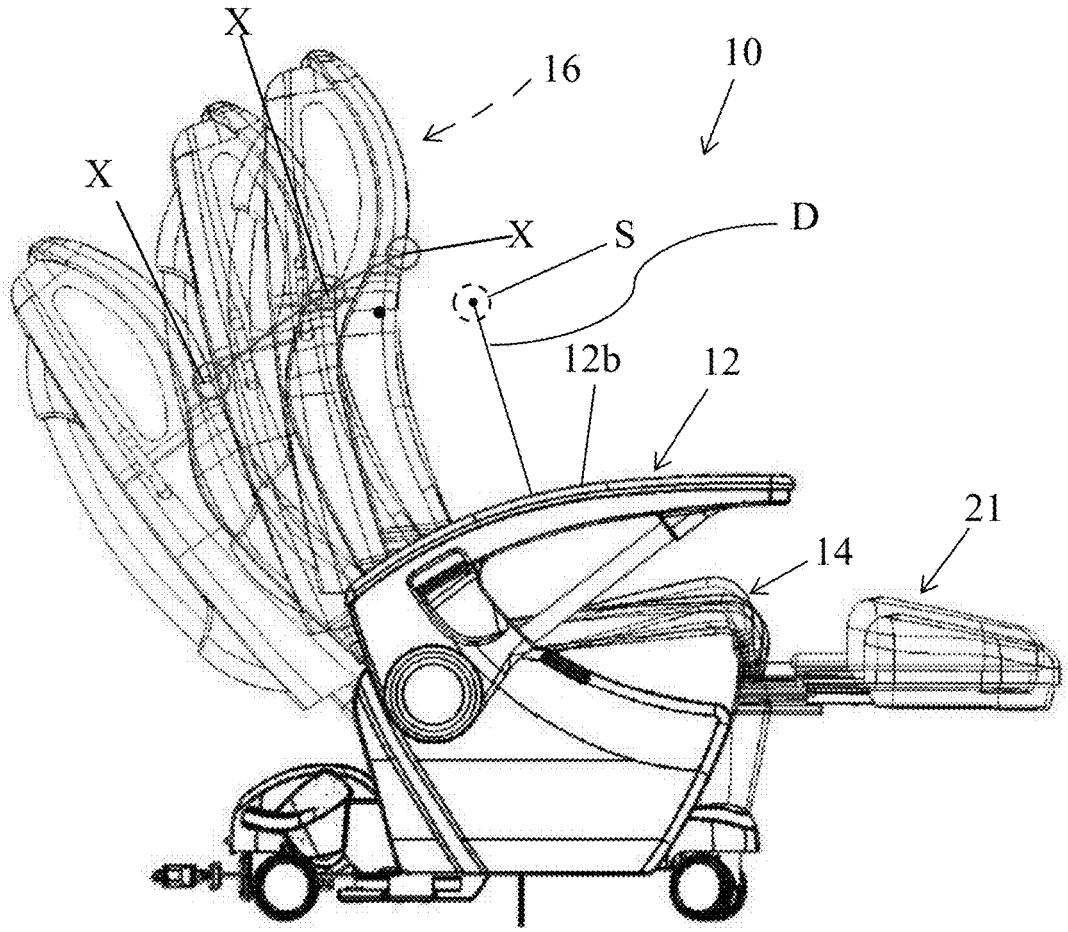
FIG. 1A is a side elevation view similar to FIG. 1 illustrating the backrest section of the medical recliner chair moving to a reclined position.
Figure 1B:
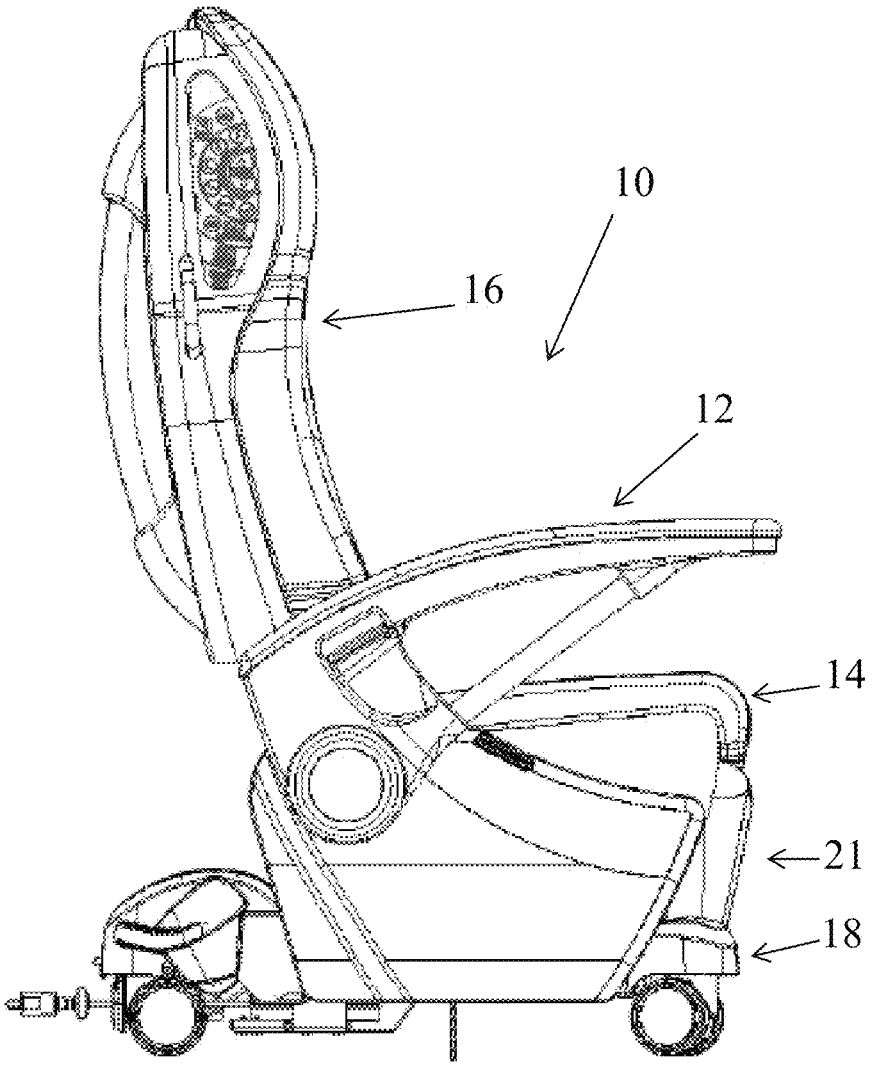
FIG. 1B is a similar view to FIG. 1 with both arms moved to their armrest position.
Figure 1C:
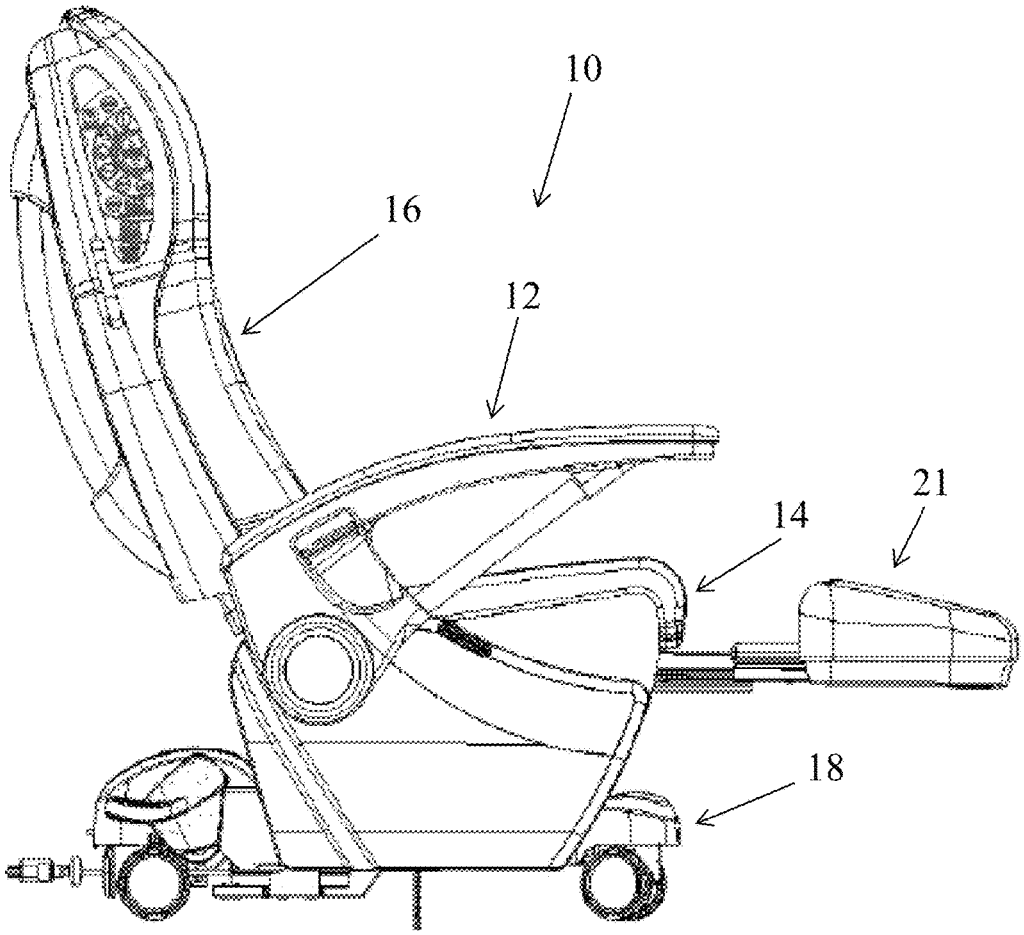
FIG. 1C is a side elevation view of the medical recliner chair shown in a seated position with the leg section extended.
Figure 1D:
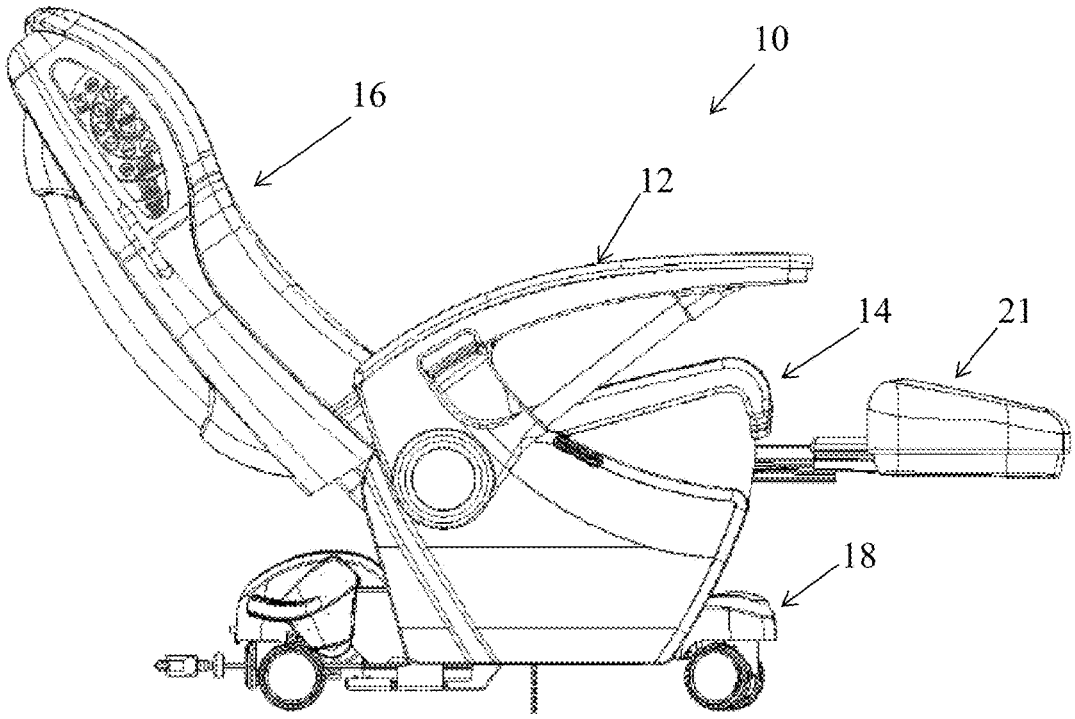
FIG. 1D is a side elevation view of the medical recliner chair shown in a reclined position and with the leg section extended.
Figure 3:
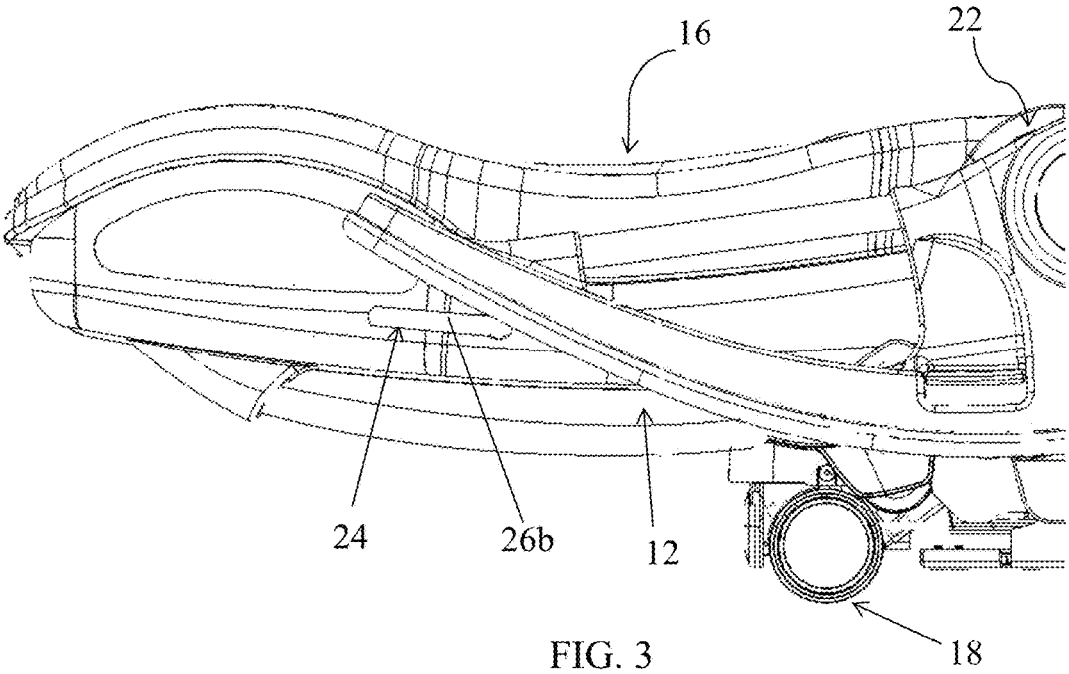
FIG. 3 is an enlarged side elevation view of the backrest portion of the medical recliner chair illustrating the backrest section in a flat position with the arm adjacent the backrest section.

Base 18 supports a chassis frame 20 (e.g. FIGS. 1E and 1F), which in turn supports the seat section and the backrest section 16, as well as a leg section 21 (FIGS. 1, and 1A-1E). Seat section 14 and backrest section 16 are pivotally mounted to frame 20, so that seat section 14 and backrest section 16 can be articulated between their seated orientation (FIG. 1) and their various reclined positions, including a flat position (FIGS. 1A and 3). Similarly, leg section 21 is mounted to frame 20, so that it can be retracted, such as shown in FIG. 1, or extended, such as shown in FIG. 1A. Frame 20 is mounted to base 18 by a lift assembly, such an X-frame, so the height of the seat section, as well as the backrest section 16, may be adjusted relative to floor F. For further details of a suitable lift mechanism reference is made to U.S. patent application Ser. No. 14/212,417 filed Mar. 14, 2014, Ser. No. 14/212,009 filed Mar. 14, 2014, Ser. No. 14/212,323 filed Mar. 14, 2014, and Ser. No. 14/212,253 filed Mar. 14, 2014, which are commonly assigned to Stryker Corporation of Kalamazoo, Mich., and are incorporated by reference in their entireties herein.

Seat section 14 is pivotally mounted to frame 20 about a pivot axis 14*a* (FIG. 1F) so that the angle of the seat section may be adjusted. Similarly, backrest section 16 is pivotally mounted to frame 20 about a pivot axis 16*a* (FIG. 1E), which is movable along an arcuate slot 16*b* (FIGS. 1E and 1F) in a plate bracket 16*c* (FIG. 1F) that is mounted to frame 20. In this manner, the seat and back rest sections are articulatable in manner to avoid pinching a patient and in manner that reduces shear. For further details of the movement of and how seat section 14, backrest section 16, and leg section 21 are mounted to frame 20, reference is made to U.S. patent application Ser. No. 14/212,417 filed Mar. 14, 2014, Ser. No. 14/212,009 filed Mar. 14, 2014, Ser. No. 14/212,323 filed Mar. 14, 2014, and Ser. No. 14/212,253 filed Mar. 14, 2014, which are commonly assigned to Stryker Corporation of Kalamazoo, Mich., and are incorporated by reference in their entireties herein.

To raise frame 20, and move seat section 14 and/or backrest section 16, apparatus 10 includes a plurality of actuators, such as linear actuators, including motorized liner actuators, associated with each of the lift assembly, the seat section 14, and the backrest section 16. The actuators are controlled by a patient support apparatus based control system by way of an operator control panel P1 (FIG. 1), more fully described in the above referenced patent applications, which is mounted to backrest section 16 above the tip of arm 12, when arm 12 is raised and aligned with backrest section 16. In this manner, even when raised, arm 12 will not interfere with the use of control panel P1.

Referring again to FIG. 1, arm 12 is pivotally mounted to patient support apparatus 10 about a pivot axis 12*a*, which allows arm 12 to pivot between an armrest position, such as shown in FIG. 1, and one or more raised positions, also shown in FIG. 1, in which arm 12 is rotated in a counter clockwise direction as viewed in FIG. 1 so that it is adjacent to the backrest section 16. In the illustrated embodiment, pivot axis 12*a* is located beneath seat section 14, namely below the cushioned top surface of seat section 14 so that when arm 12 is pivoted to its most counterclockwise position as viewed in FIG. 1, arm 12 will be beneath the cushioned surfaces of both seat section 14 and backrest section 16 so as not to interfere with the lateral transfer of a patient off apparatus 10.

In one embodiment, arm 12 is coupled, and optionally releasably coupled, to backrest section 16 so that arm moves with backrest section 16 when backrest section 16 is lowered, for example to a reclined position (FIG. 1A) or a flat position (FIG. 3) where a person supported on patient support apparatus 10 can lie flat on their back. In the illustrated embodiment, and as best seen in FIG. 2, backrest section 16 supports a stop 24, optionally in form of a hook, which releasable couples arm 12 to backrest section 16 (at least in one direction) when arm 12 is raised adjacent backrest section 16.

As will be more fully described below, when arm 12 is raised it is unlocked and further has a center gravity offset from its pivot axis 12*a* such that when arm is raised, for example in the position shown in FIG. 1, the weight of the arm will apply a rotational moment to arm 12 in a counter clockwise direction as seen in FIG. 1. The counterclockwise motion of arm 12 is, however, blocked by stop 24. Therefore, as backrest section 16 is lowered to a reclined position, arm 12 will rotate with backrest section 16 under the force of gravity.

Figure 2:
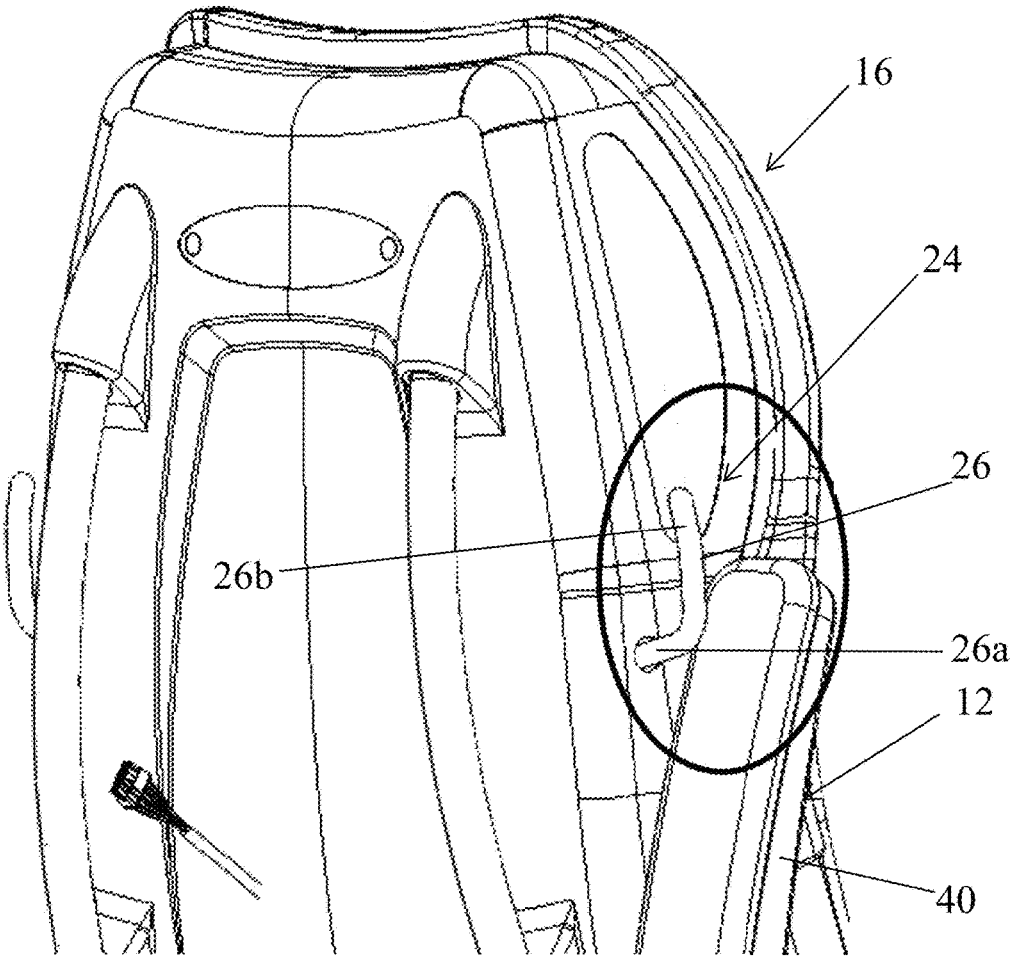
FIG. 2 is an enlarged rear fragmentary, perspective view of the backrest section of the medical recliner chair of FIG. 1 in a raised position and with the arm in a raised position.

As best seen in FIG. 2, stop 24 is formed by a generally L-shaped bar 26. One arm 26*a* of bar 26 is mounted to backrest section 16, with its other arm 26*b* positioned to catch arm 12 and stop further rotation of arm 12 about horizontal axis 12*a* beyond stop 24. It should be understood that arm 26*a* or the juncture of arm 26*a* and arm 26*b* may form the stop for arm 12. Further, the shape of stop 24 may be varied. For example, stop 24 may have another geometric shape, such as a semi-circular shape, or be a combination of geometric shapes, or be shaped as a polyline—that is a shape formed from one or more straight or curved segments of a rod or a bar or a combination of both. The location can also be varied, but optionally is located on the back or side of backrest section 16 where it does not interfere with the use of the user control panel P1 but is still at a location where it can act as a stop for arm 12. Optionally, as shown in FIG. 1, when the arm 12 is coupled to the backrest section 16, arm 12 is below or behind the extended planes of the support surface of patient support apparatus 10. In other words, the arm 12 is out of the way and no longer forms a barrier at the side of the patient support apparatus 10. The term "extended planes" in this context refers to the planes in which each of the upper surface of the support surfaces, i.e. back section cushion, seat section cushion, and foot/leg section cushion, lie and that are extended from either side of the chair.

Further, stop 24 may be movably mounted for movement between a deployed position, where stop 24 can be releasably coupled to arm, and a stowed position, so that it can be selectively deployed for selectively, releasably coupling to the arm. In addition, stop 24 may form a support for an IV bag or other accessories or may form a line management device.

As more fully described below, arm 12 is not locked when rotated from its armrest position and instead is free to move with backrest section 16 as backrest section 16 is lowered. Thus, as noted above, when backrest section 16 is lowered to the left as viewed in FIG. 1, stop 24 will move with backrest section 16 to allow arm 12 (under the force of gravity) to move with backrest section 16 in a counterclockwise direction as viewed in FIG. 1.

Figure 1E:
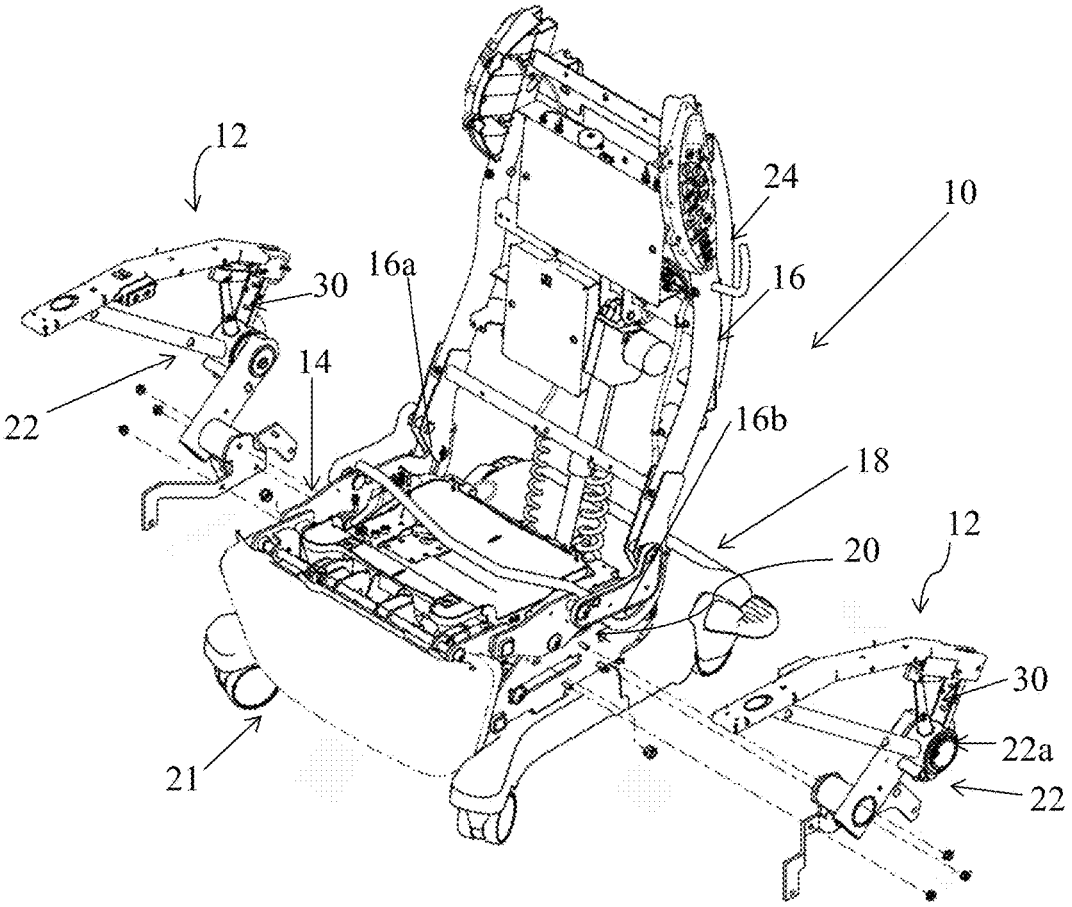
FIG. 1E is a partial exploded perspective view of the recliner chair of FIG. 1 with the cushions and covers removed for clarity.
Figure 1F:
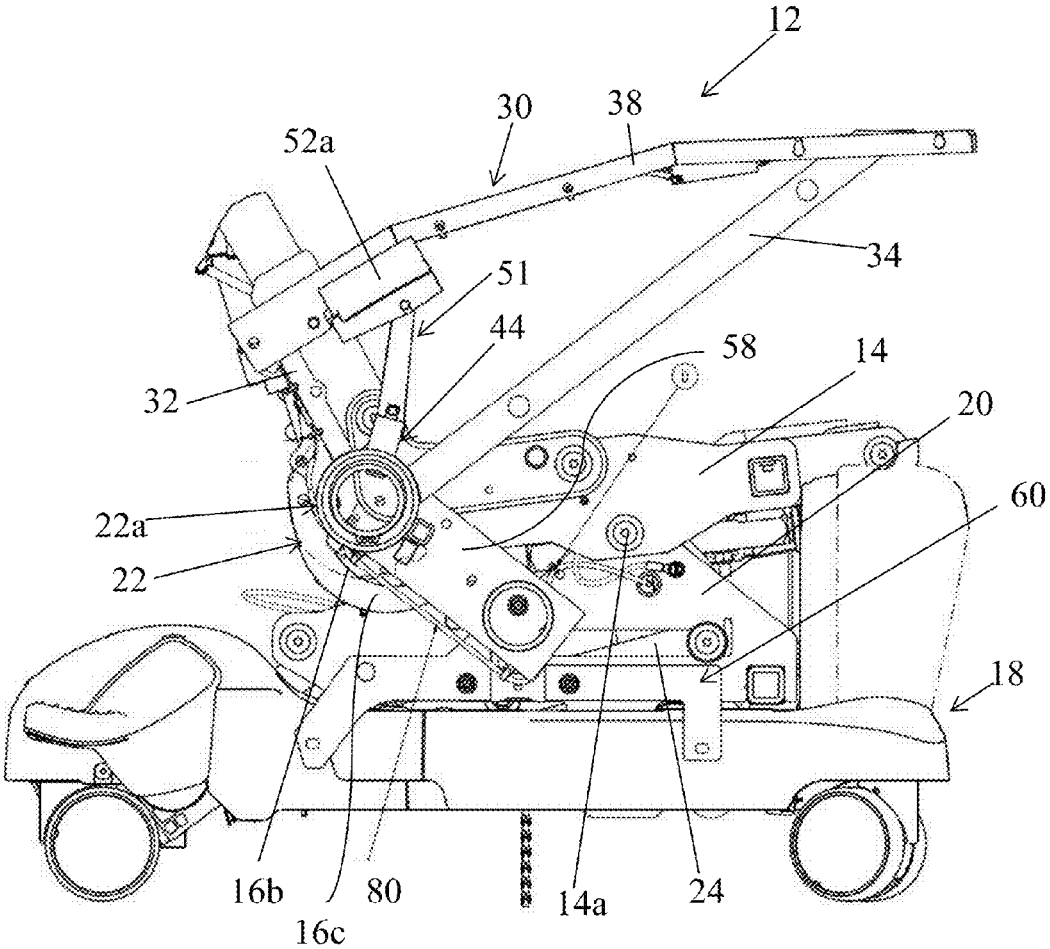
FIG. 1F is an enlarged side elevation view of the base and the arm mounting assembly of the recliner chair.

In the illustrated embodiment, and as best seen in FIG. 1F, arm 12 is pivotally mounted by an arm mounting assembly 22 to frame 20. In this manner, when frame 20 is raised or lowered by the lift assembly, arm 12 will be raised and lowered with frame 20 along with seat section 14. Further, when arm 12 is in its locked position and frame 20 is raised or lowered, arm 12 will remain in its locked orientation and remain in the same or constant relative orientation to the floor. In other words, arm 12 does not change its angular orientation to the floor when arm is in its locked position, regardless of the position of the backrest section 16 or the seat section, or regardless of the height of frame 20. This provides a stable surface for a patient to hold onto when they move forward in the apparatus and are trying to exit the chair. In one embodiment, patient support apparatus 10 may be configured to provide a "sit-to-stand" function, where the seat section lifts up and tilts forward as the person is exiting the apparatus to provide additional support to the person as they stand up from the apparatus. For further details on an optional sit-to-stand configuration and mechanism, reference is made to U.S. patent application Ser. No. 14/212,323 filed Mar. 14, 2014, which is commonly assigned to Stryker Corporation of Kalamazoo, Mich., and incorporated by reference in its entirety herein.

Alternately, arm 12 may be mounted to frame 20 by a bracket or another mount that allows arm 12 it change it angular orientation, either based on a user's adjustment or based on an automatic adjustment in response to movement of one of the chair's components, such as the seat section.

Optionally, arm mounting assembly 22 may be mounted to the seat section instead. In this embodiment, arm 12 could then move with the seat section when it is raised or tilted relative to frame 20 and would, therefore, no longer retain the same angular orientation to the floor when the seat is tilted. Alternately, arm 12 may be mounted to seat section 14 by a bracket or another mount that allows arm 12 maintain its angular orientation, either based on a user's adjustment or based on an automatic adjustment in response to movement of seat section.

In order to provide an arm rest surface that is available for use by a person seated on apparatus 10 through the range of motion of backrest section 16 relative to frame 20, arm 12 includes a padded curved upper surface 12*b* (FIG. 1A). Optionally, the arm rest surface is available for use by a person seated on apparatus 10 through a limited the range of motion of backrest section 16 relative to frame 20, e.g. between a seated position and its reclined positions, optionally even in flat position. In one embodiment, padded curved upper surface 12*b* has a curvature that is generally parallel to a path defined by a point X (FIG. 1A) on the backrest section 16 when the backrest section 16 is pivoted from its seated position to its reclined position(s). In this manner, the distance D from a shoulder S of a person sitting in apparatus 10 to the upper surface 12*b* of the arm remains generally the same regardless of the position of the backrest section 16 of the chair.

As noted above, mounting assembly 22 pivotally mounts arm 12 to frame 20 about a pivot axis 12*a* (FIG. 1) between a first position, namely a locked, armrest position (far arm in FIG. 1, see also FIG. 6, 7), and multiple unlocked raised positions in which arm 12 is raised relative to seat section 14. As noted above, arm 12 may be moved adjacent backrest section 16, as described above and shown in FIG. 1 (for the closest arm), and move with backrest section 16 when it is tilted to a reclined position or to a flat position or even to a Trend position.

Figure 5:
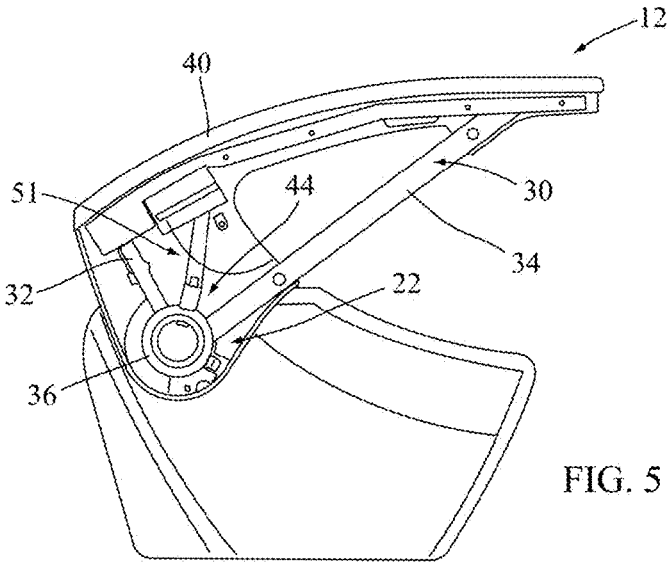
FIG. 5 is a similar view to FIG. 4 with the cover of the arm removed for clarity.
Figure 12:
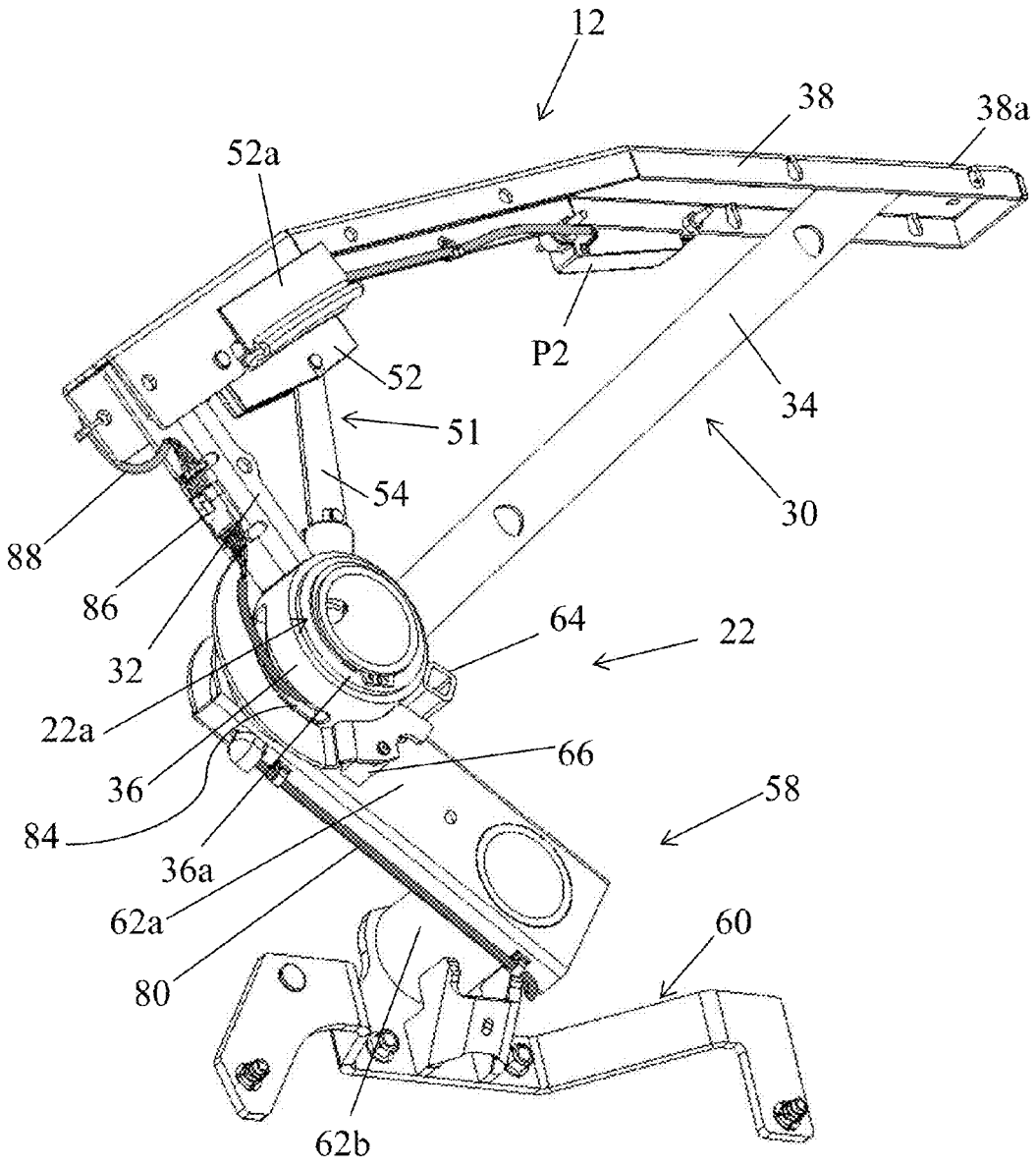
FIG. 12 is a perspective view of the arm and the arm mounting assembly illustrating the cable routing through the arm.
Figure 12A:
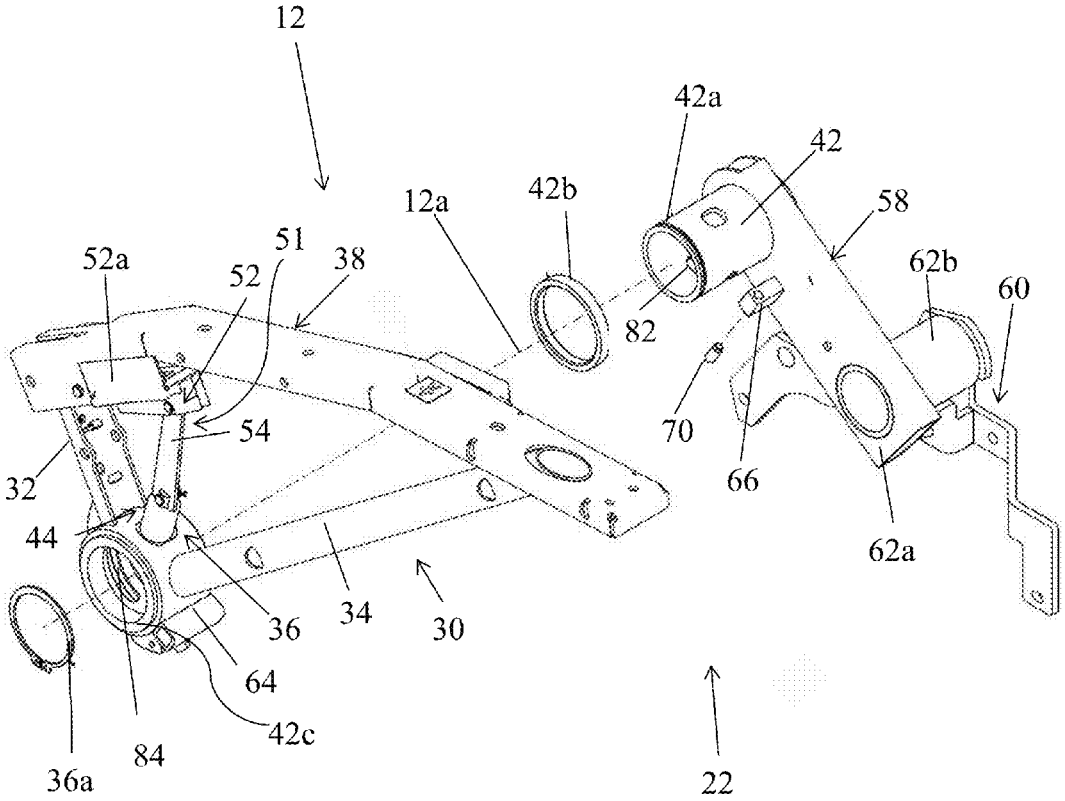
FIG. 12A is an exploded perspective view of the arm and the arm mounting assembly.

As best in FIGS. 1E, 5, and 12A, each arm 12 includes an arm frame 30 that has a generally triangular configuration and which is formed by two radial frame members 32 and 34 (FIGS. 5 and 12A). Frame members 32 and 34 are commonly mounted at one end thereof to a pivot member 36. Pivot member 36 is formed by a cylindrical member, which mounts mounting assembly 22 to frame 20. Mounted to the opposed ends of frame members 32 and 34 is a channel shaped member 38 (FIG. 12A), which forms an upper support 38*a* for mounting a cover or covers over arm 12, and which support a cushion 40 to form a cushioned arm rest, which will be more fully described below.

As best seen in FIG. 12A, pivot member 36 is rotatably mounted about a stationary member 42 (i.e., stationary relative to frame 20), which is also formed from a cylindrical member, which is fixedly mounted to frame 20. Thus, stationary member 42 forms a spindle tube about which pivot member 36 rotates to form a pivotal connection 22*a* (FIGS. 1 and 12) for mounting assembly 22 about pivot axis 12*a*. To selectively lock the position of arm 12 about stationary member 42, mounting assembly 22 includes a locking mechanism 44 (e.g. FIGS. 6-7 and 12A).

Figure 6:
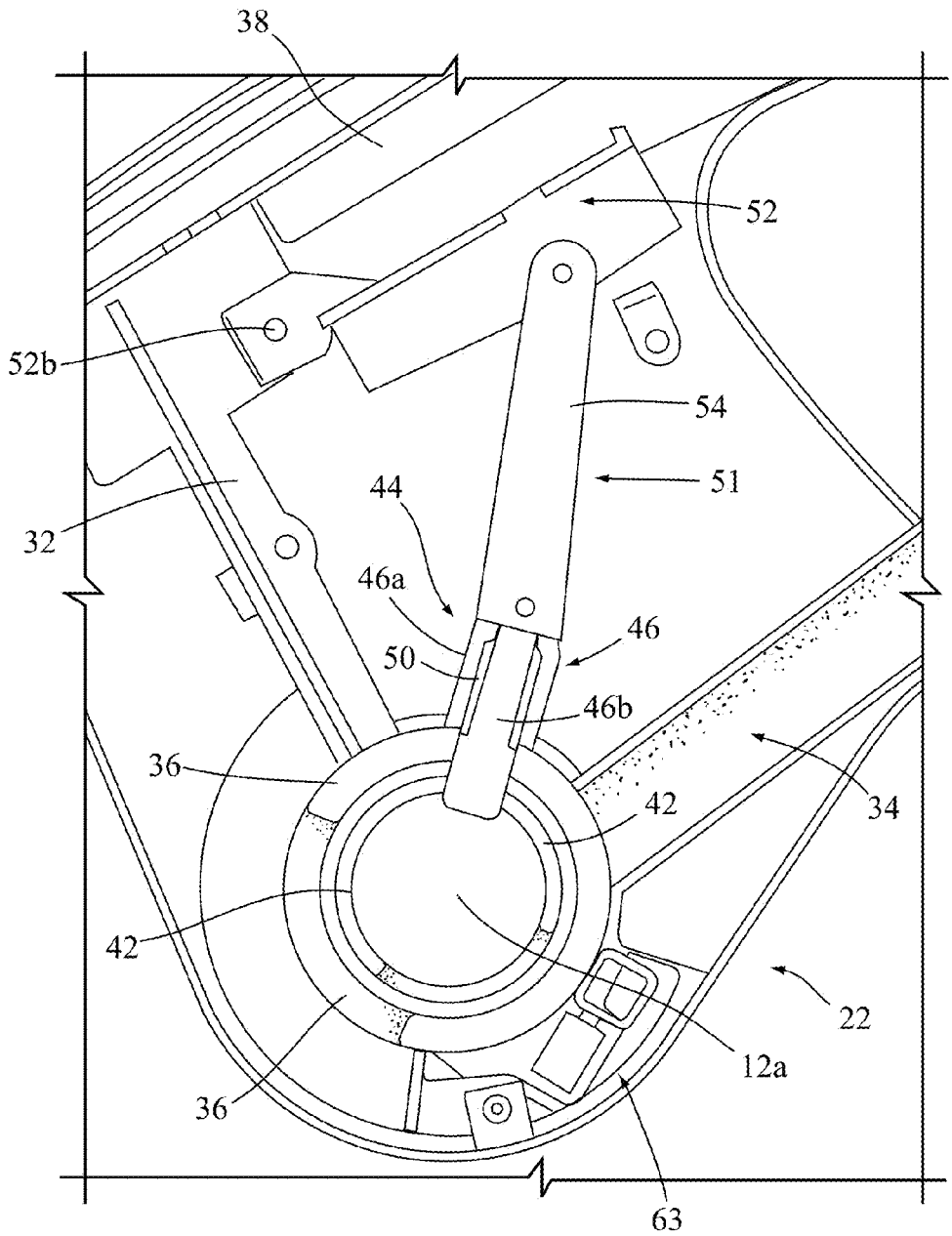
FIG. 6 is an enlarged fragmentary elevation view of the arm mounting assembly illustrating the arm in a locked armrest position.
Figure 7:
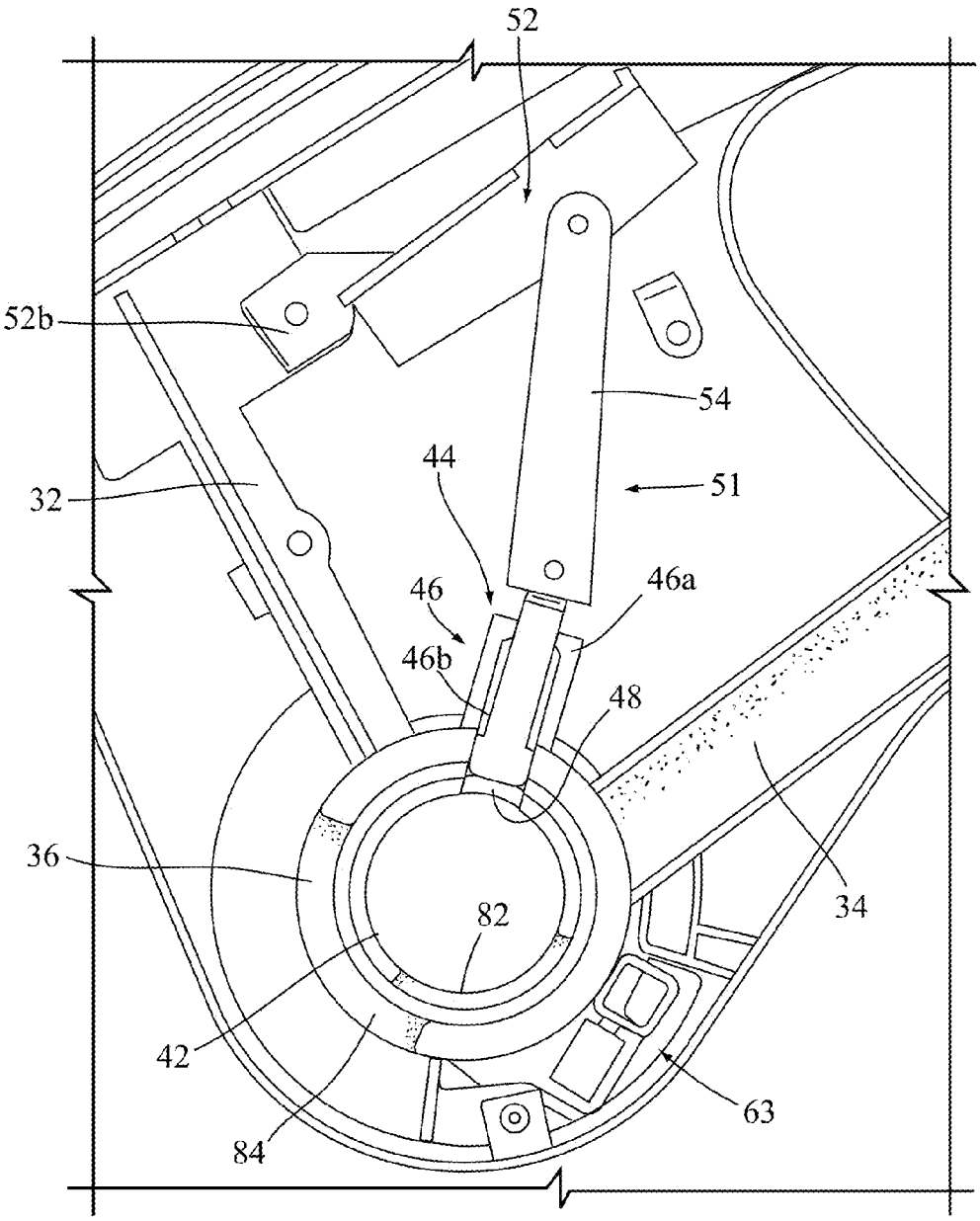
FIG. 7 is a similar view to FIG. 6 illustrating the locking mechanism unlocked.
Figure 8:
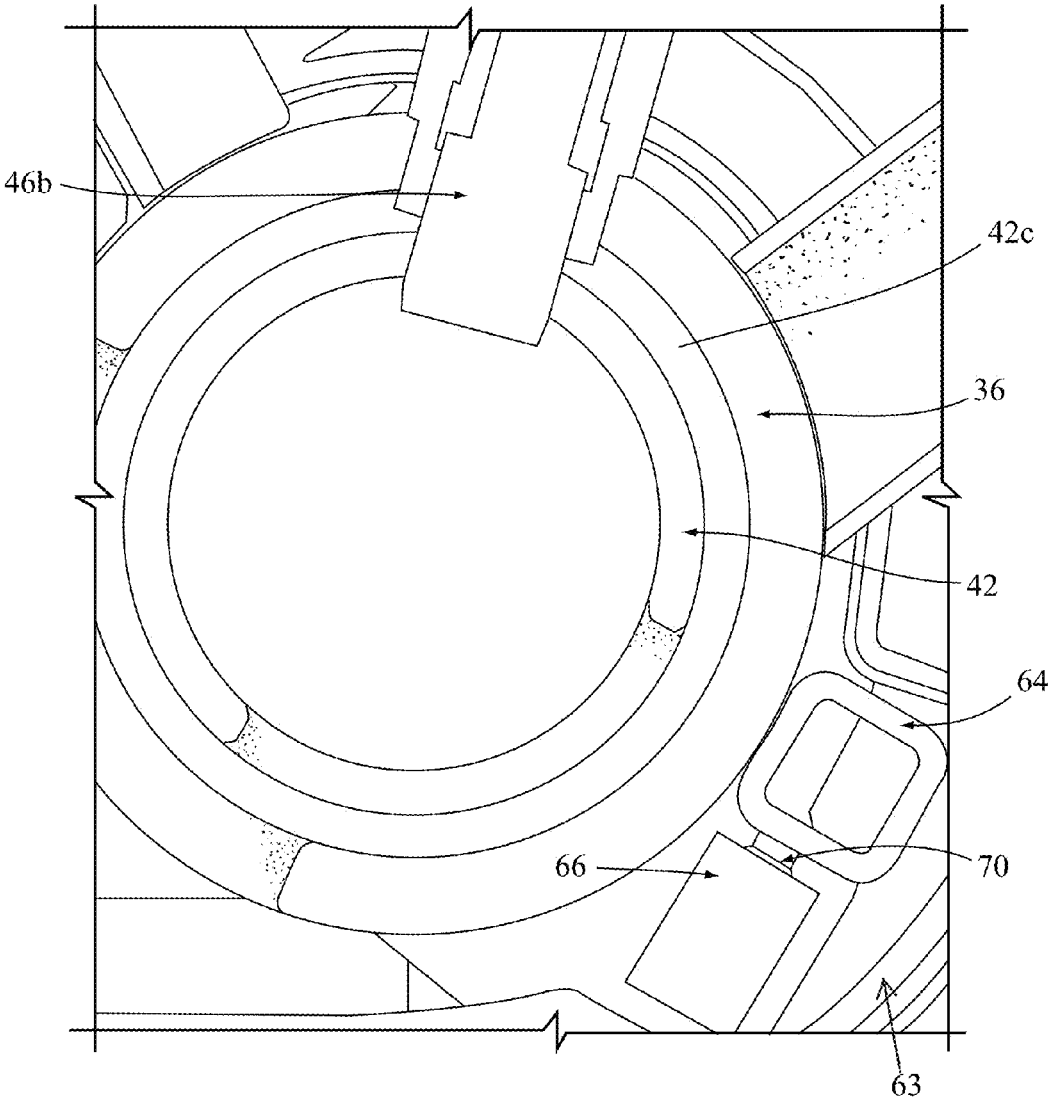
FIG. 8 is another enlarged fragmentary view of the arm mounting assembly in a locked position and illustrating a fit-up mechanism.

In the illustrated embodiment, locking mechanism 44 comprises a plunger 46 (FIGS. 6-7). Plunger 46 may be formed from a housing 46*a* and a pin 46*b* that is movably mounted in housing 46*a* for selective engagement with stationary member 42. In the illustrated embodiment, housing 46*a* is joined with pivot member 36 about an opening formed in the wall of pivot member 36, such as by welding, so that housing 46*a* and pivot member 36 are fixed relative to each other.

As shown in FIGS. 6-9, pin 46*b* of plunger 46 is movable between a non-locking position (FIG. 9) and a locking position (FIGS. 6 and 8) where pin 46*b* extends through pivot member 36 to selectively engage a notch 48 formed in stationary member 42. Notch 48 is generally commensurate in size with pin 46*b* so that when pin 46*b* is extended into notch 48, the position of pivot member 36 is fixed relative to stationary member 42. Further, pin 46*b* is biased into its locked position by a spring 50 (shown in FIGS. 6 and 12C), and is disengaged from its locked position by a release mechanism 51 (FIGS. 4-7). As best understood from FIG. 12C, spring 50 is mounted about a base 46*c* of pin 46*b* and is trapped between the upper end 46*e* of housing 46*a* and a shoulder 46*d* formed on pin 46*b* to thereby urge pin 46*b* toward stationary member 42 and into notch 48. Alternately, the pin can be mounted in the stationary member 42, and the notch may be formed in the pivot member.

Figure 4:
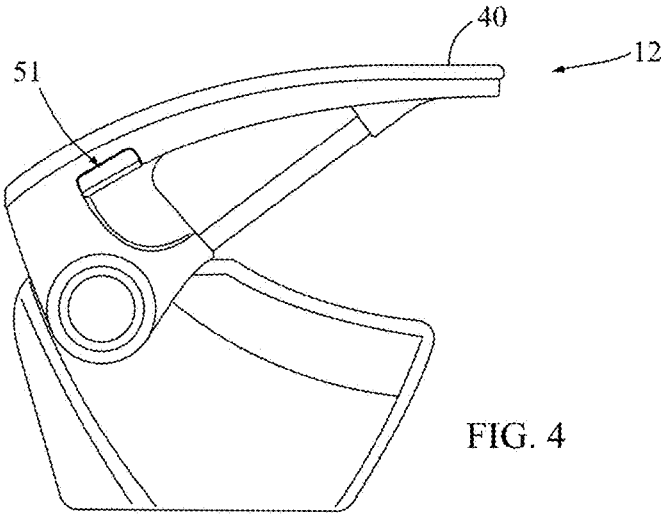
FIG. 4 is an enlarged fragmentary view of the medical recliner chair FIGS. 1-3 illustrating the arm in an armrest position.
Figure 12B:
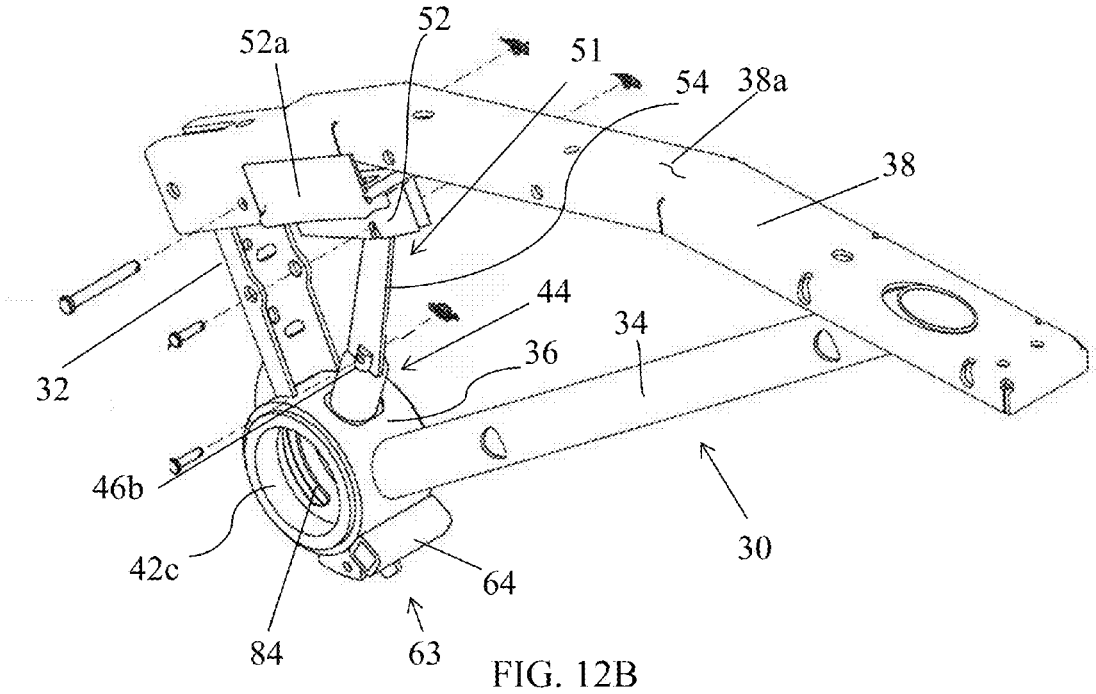
FIG. 12B is a perspective view of the arm frame of the arm.
Figure 12C:
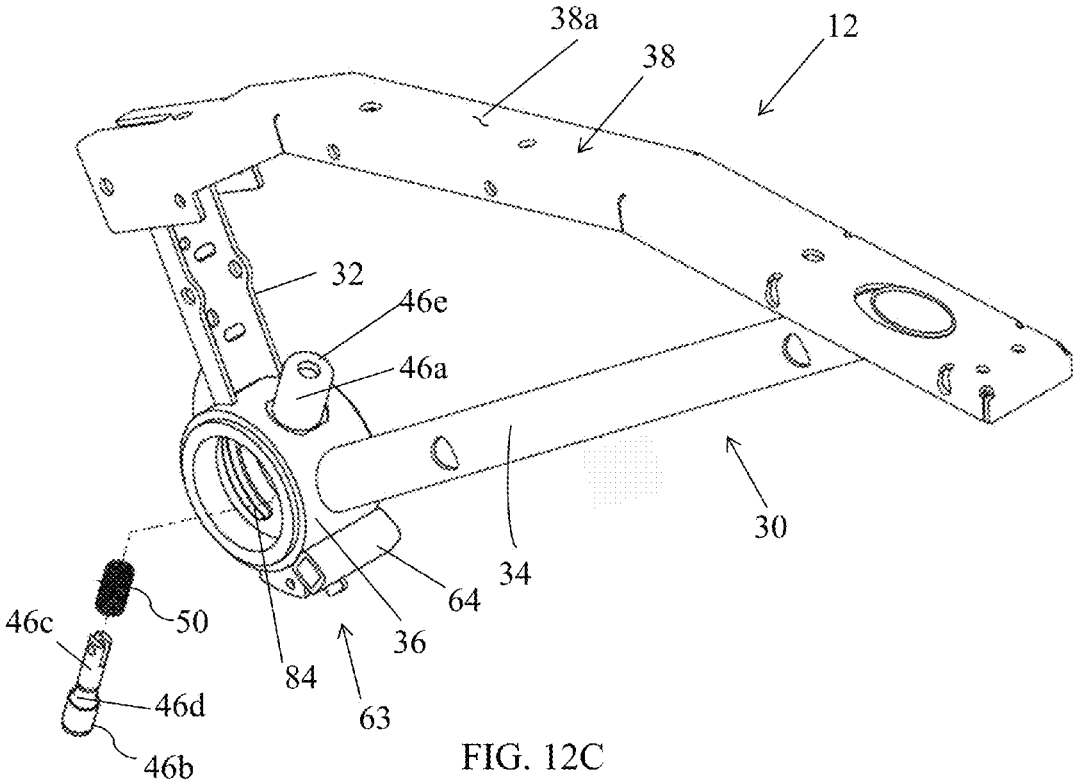
FIG. 12C is an exploded, fragmentary view of the arm frame.
Figure 12D:
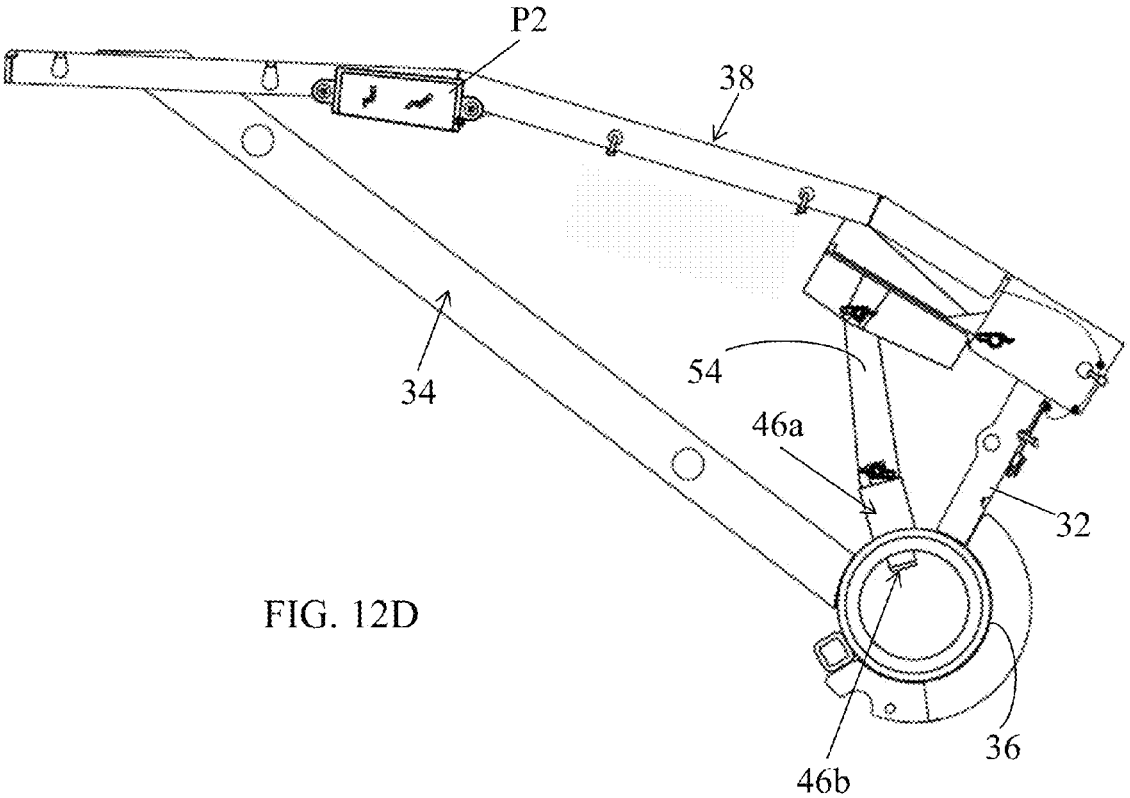
FIG. 12D is an elevation view of the arm frame.
Figure 12E:
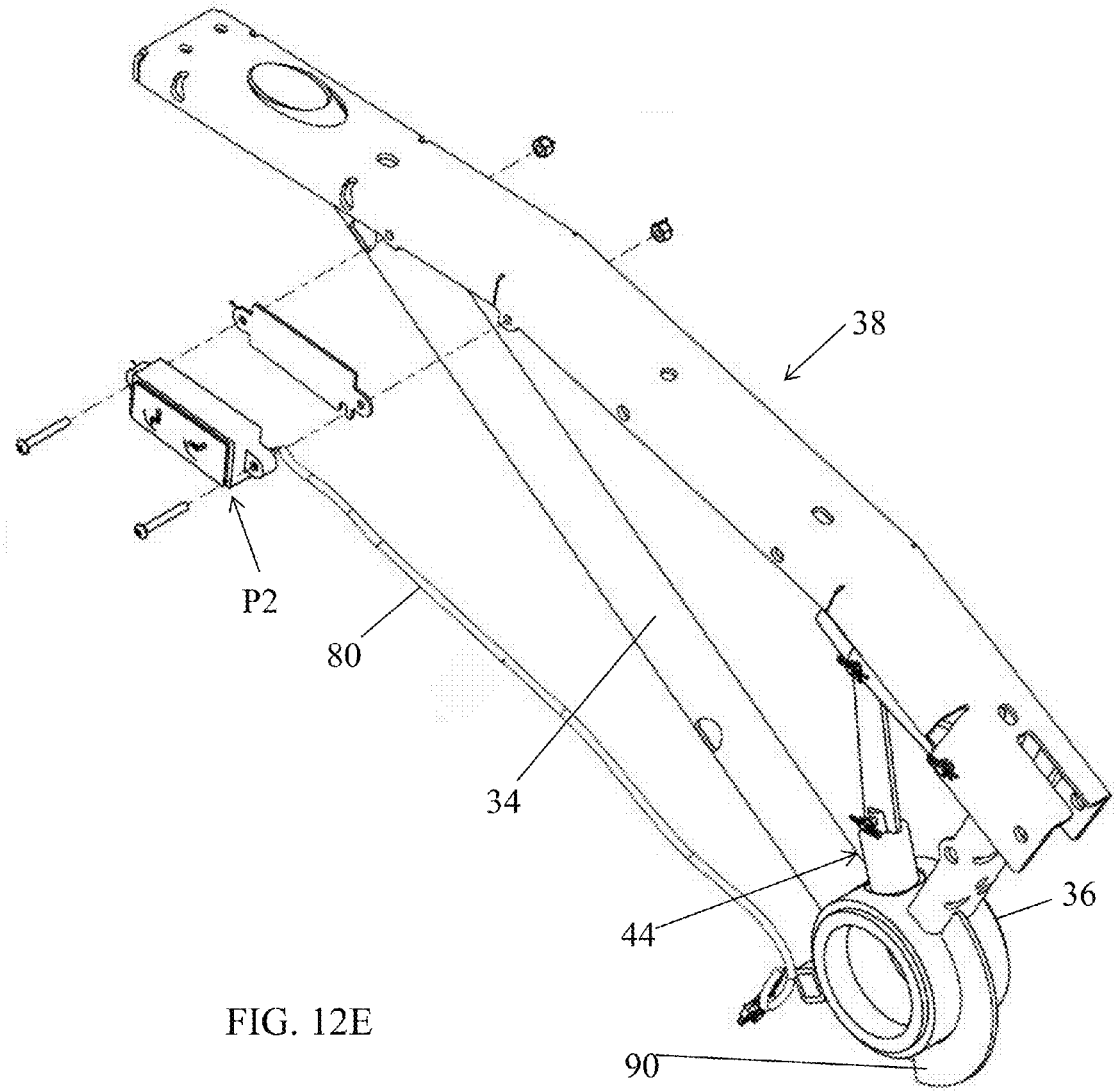
FIG. 12E is another perspective view of the arm frame.

In the illustrated embodiment, and as shown in FIGS. 12A and 12B, release mechanism 51 includes a handle 52 that is coupled to the end of pin 46*b* by way of a link 54 (e.g. FIG. 7). Handle 52 comprises a pivotal handle and is pivotally mounted on one end to arm frame 30, with its free end pivotally coupled to the end of link 54 so that when handle is activated, i.e. pivoted about its pivot axis 52*b* (FIG. 6), link 54 pulls on pin 46*b* to thereby disengage pin 46*b* from notch 48. As best seen in FIGS. 4, 5, and 12, handle 52 includes a handgrip portion 52*a*, which is located in the side of arm 12 (and which extends through an opening provided in the cover) for access by a caregiver or a patient. Once the locking mechanism is disengaged, arm 12 may be pivoted about pivot axis 12*a* at which point pin 46*b* will no longer be aligned with notch 48. In this manner, arm 12 may be raised to an infinite number of positions, including where arm 12 aligns with backrest section 16 (where arm 12 is out of the way and no longer forms a barrier at the side of the patient support apparatus 10). It should be understood that arm 12 may have more than one locked position; therefore, stationary member 42 may have more than one notch. Additionally, stationary member 42 may have a slot adjacent notch 48, for example a shallower elongated notch, into which pin 46*b* can extend into and slide as arm 12 is moved, but which includes an end wall that forms a stop to define the outer boundary of the arms unlocked position.

When unlocked and arm 12 is pivoted about pivot axis 12*a*, handle 52 may be released, and pin 46*b* will be urged against and ride on the outer perimeter of stationary member 42. As such, when arm 12 is returned to its armrest position while handle 52 is no longer activated, pin 46*b* will automatically engage notch 48 once again to lock the position of arm in its locked armrest position.

Referring again to FIGS. 12 and 12A-12E, mounting assembly 22 includes a weldment 58 and a bracket 60, which mounts mounting assembly 22 to frame 20. Stationary member 42 is mounted, such as by welding, to weldment 58 to thereby fix the position of stationary member 42 relative to frame 20. Weldment 58 includes a tubular member 62*a* and a cylindrical member 62*b*, which mounts tubular member 62*a* to bracket 60.

As noted above, pivot member 36 is mounted on stationary member 42 and is retained thereon by a retaining ring 36*a* (FIGS. 12 and 12A), which engages a groove 42*a* formed in the end of stationary member 42. Further, a spacer ring 42*b* may be provided around stationary member 42 to abut pivot member 36 and control the spacing between pivot member 36 and weldment 58 to thereby adjust the position of arm 12 relative to the side of patient support apparatus. Optionally, arm 12 is positioned to be close to, if not abut, the side of apparatus 10 to minimize the transfer gap when the patient is laterally transfer off apparatus. To reduce friction between pivot member 36 and stationary member 42, pivot connection 22*a* may also include one or more bearings, such as annular bearings 42*c* (FIG. 12A), which may be press-fit into the opposed open sides of pivot member 36.

Optionally, to ease the fit-up between the locking assembly pin 46*b* and notch 48 in stationary member 42, mounting assembly 22 may include a fit-up mechanism 63 (FIGS. 6-11) that forms an adjustment mechanism that can fine-tune the alignment of pivot member 36 on stationary member 42 during assembly, which can reduce slop in the arm.

Figure 9:
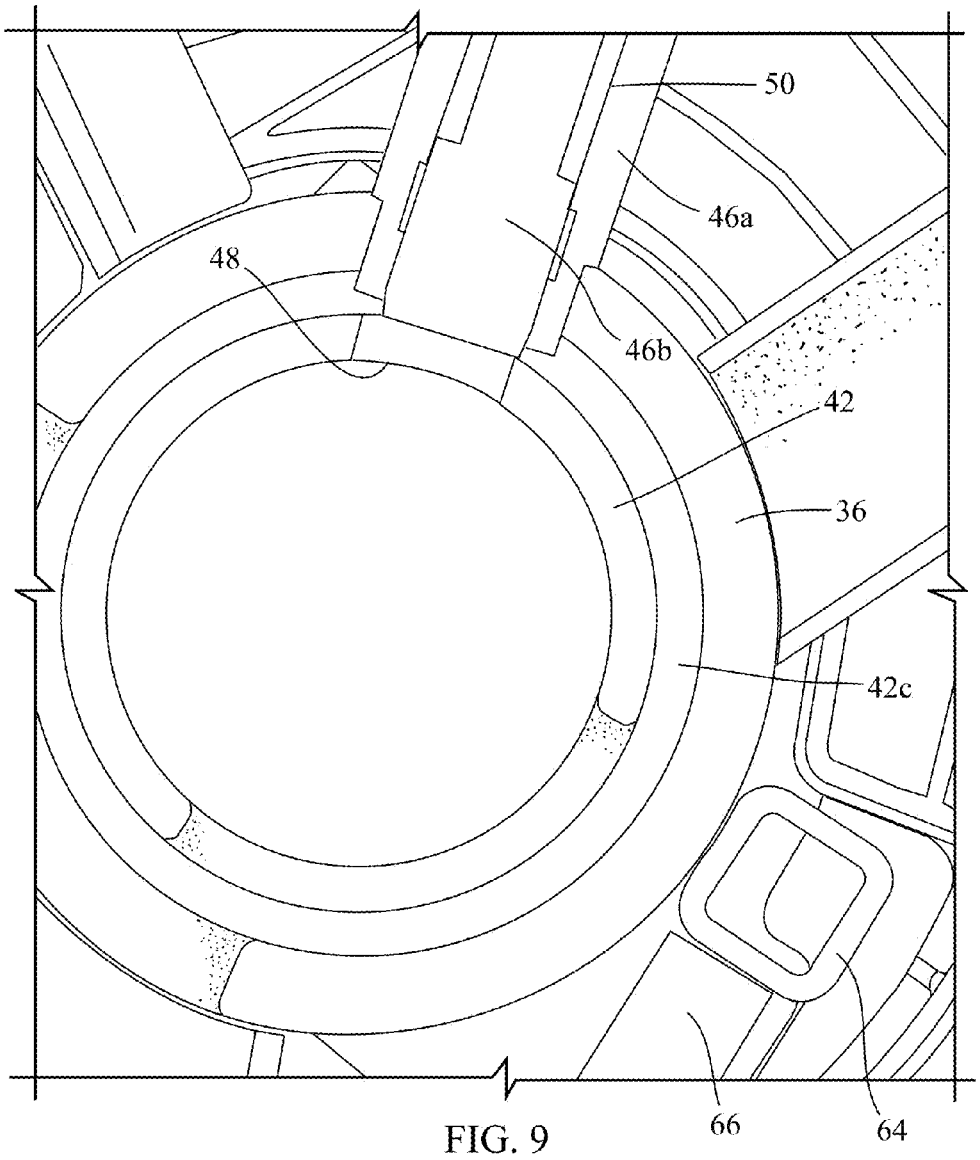
FIG. 9 is a similar view to FIG. 8 with the locking mechanism pin in an unlocked position and unable to move into the notch of the fixed member of the mounting assembly without the set screw of the fit-up mechanism.

When assembling the arms onto apparatus 10, each arm can be first mounted so that the locking mechanism is nearly aligned with the notch on the stationary member, such as shown in FIG. 9. By "nearly aligned", it is meant that the locking mechanism has a least a portion of the pin hovering over the notch (in other words, there's an overlap between the bottom surface of the pin and the top surface of the notch), but not sufficiently aligned so that the pin of the locking mechanism can extend into the notch. Optionally, the arm may be initially mounted so that the pin of the locking mechanism is generally aligned with the notch so that there is sufficient clearance for the pin to extend into the notch.

Figure 10:
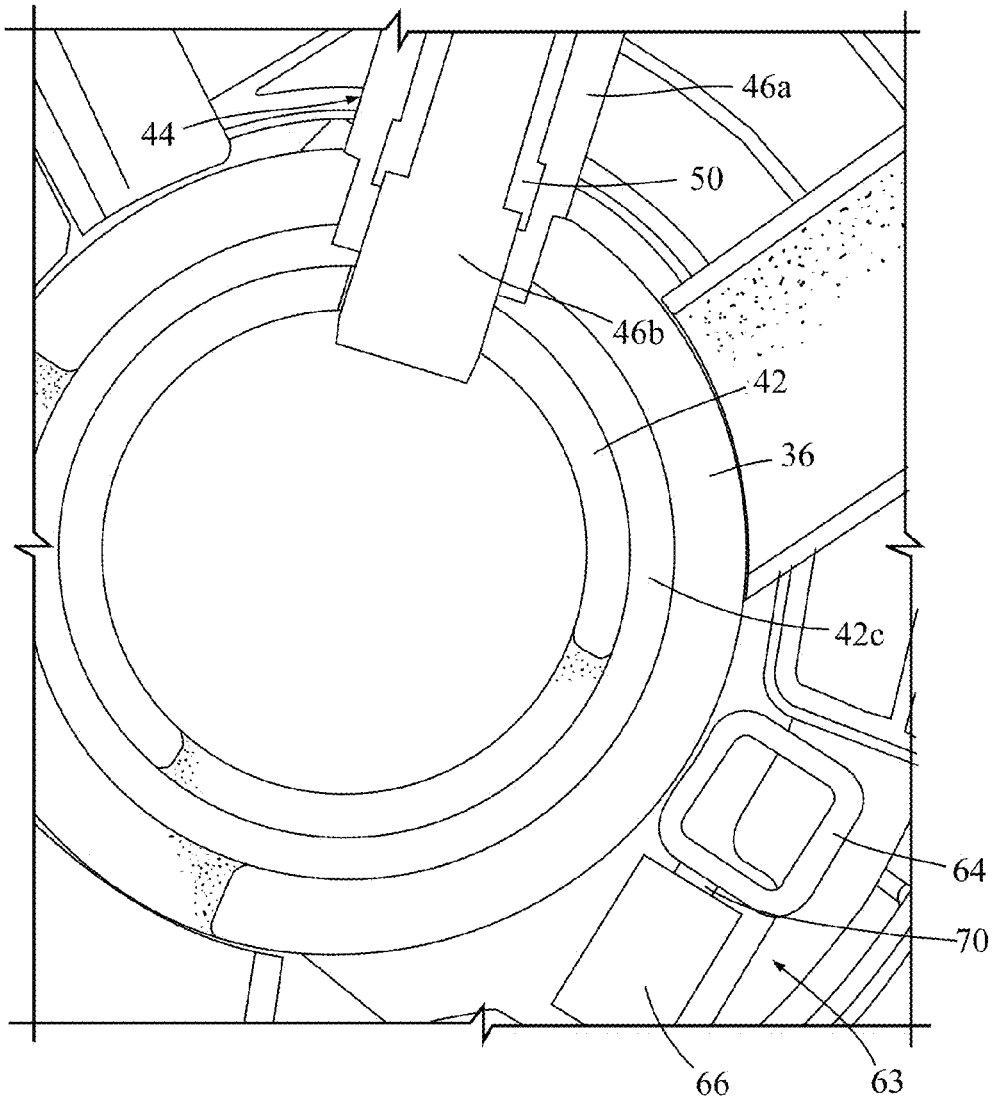
FIG. 10 is a similar view to FIG. 9 with the set screw of the fit-up mechanism adjusted to a first position to allow the locking mechanism pin to move into the notch of the fixed member of the mounting assembly.
Figure 11:
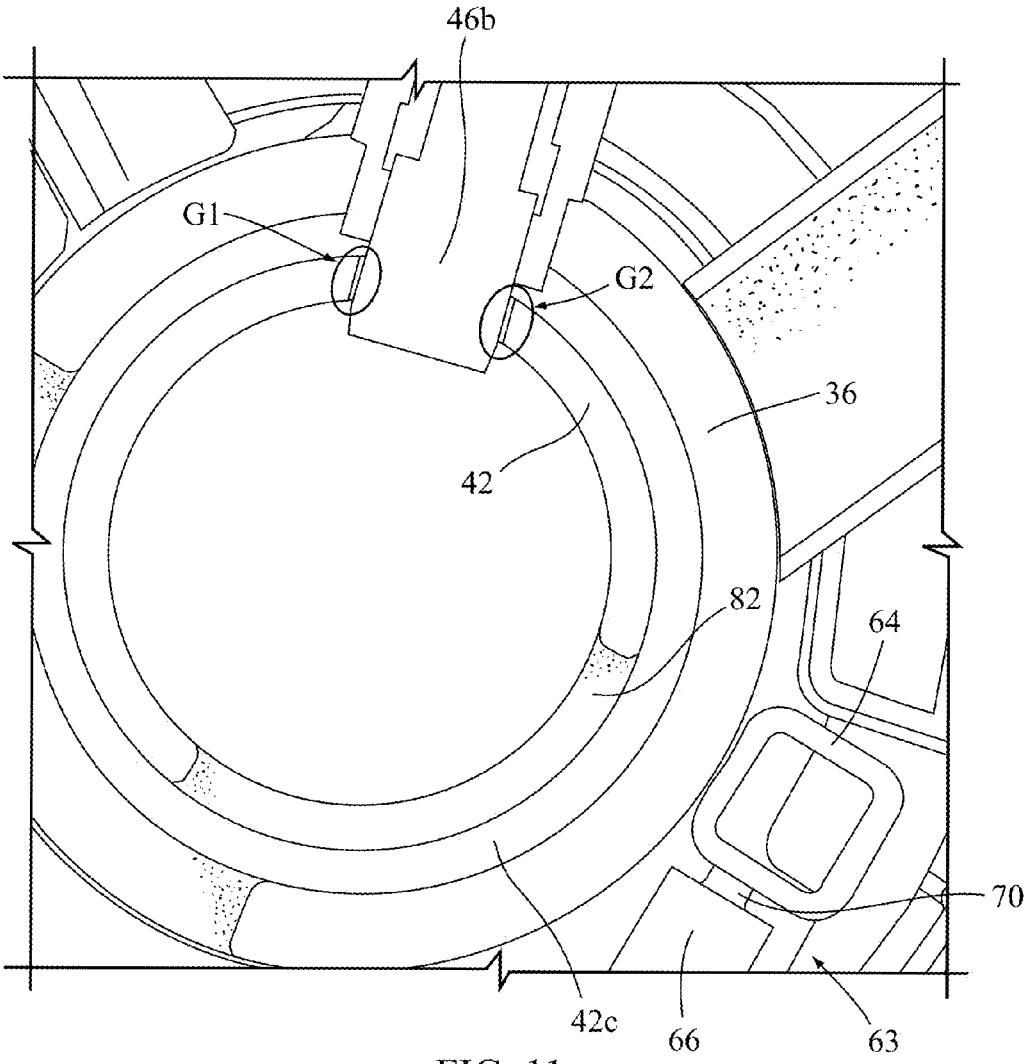
FIG. 11 is a similar view to FIG. 10 illustrating the set screw adjusted to a second position to decrease the gap between one side of the locking mechanism pin and the fixed member of the mounting assembly.

Regardless of the initial starting point (i.e. nearly aligned or generally aligned), the pin's alignment in notch 48 can be fine-tuned using fit-up mechanism 63, such as shown in FIG. 10. In the illustrated embodiment, fit-up mechanism 63 includes a stop, for example in the form of a stop tube 64. Stop tube 64 is mounted to pivot member 36, for example by welding, and as described below enables reduction of looseness or "slop" the armrest. Referring to FIGS. 8-11 and 12A, fit-up mechanism 63 also includes a stop block 66, which is fixed relative to the stationary member 42, for example, by welding. In the illustrated embodiment, stop block 66 is mounted fixed to tubular member 62*a*, which mounts to frame 20 via bracket 60. Stop block 66 is located so that it is adjacent stop tube 64 when arm 12 is mounted to weldment 58 to thereby provide a general guide for aligning the arm on weldment 58. In other words, stop tube 64 and stop block 66 provide a course alignment between locking mechanism 46 and notch 48.

At least the stop block 66 or the stop tube 64 supports a set screw 70 (FIGS. 8-11), which is threaded in or out to adjust the spacing between the stop block 66 or the stop tube 64 to rotate the pivot member 36 about the stationary member 42 to adjust the alignment of the pin of the locking mechanism with the notch.

In the illustrated embodiment, when the arm is first mounted on weldment 58, stop block 66 contacts stop tube 64, which provides the initial course alignment of the pin of the locking mechanism with the notch so that they are nearly aligned (see FIG. 9). Set screw 70 then provides the fine-tuned alignment of the pin of the locking mechanism with the notch. In the illustrated embodiment, set screw 70 is mounted in stop block 66 and is guided by stop block 66 to contact stop tube 64. Set screw 70 is then adjusted to apply pressure to stop tube 64, which rotates pivot member 36 about pivot axis 12*a* so that plunger 46 may be fine-tunely aligned with notch 48. This allows for tighter gaps between plunger 46 and notch 48, and larger tolerance on the angular position of the notch 48 with respect to the stop block 66. With tighter tolerances, gaps G1 and G2 (FIG. 11) between pin 46*b* and the two opposed sides of notch 48 can be reduced to achieve a tight fit-up between the respective parts, while also maintaining some level of gaps G1 and G2 so that the plunger does not bind in notch 48.

If there was no set screw, as soon as the stop tube 64 contacts the stop block 66, the notch 48 would have to be in the exact right position for the plunger 46 to be able to extend into the notch. As noted above, arm 12 is designed to line up in the locked position (i.e. pin is lined up with the notch) when stop tube 64 contacts stop block 66 (or vice versa). However, because of manufacturing tolerances, this may not always be the case. Therefore, when there is no set screw, alignment of the pin and the notch is more difficult. As a result, the tolerances would need to be more generous; otherwise the pin of the locking mechanism may not be able to move into its locked position as shown in FIG. 9. Depending on the misalignment, the arm rest may be raised slightly in order to obtain the proper fit of the pin into the notch. But if the only gap is on the right side in FIG. 9 (in lieu of the left side as shown in FIG. 9 when the arm is first mounted to the weldment), stop tube 64 will prevent further clockwise rotation of arm, and then the pin may not be able to move into the notch at all.

Fit-up mechanism 63 also allows greater control over the size and/or distribution of the gaps (in other word fine-tuned alignment) once the pin is generally aligned with the notch (and the pin is extended into the notch). For example, due to the weight of the arm and the moment created by the weight of the arm, it may be desirable to have G1 (the gap to the most counterclockwise edge as viewed in FIG. 11) as small as possible, e.g. zero or close to zero, and have G2 greater than G1, so that when the arm is mounted, the moment induced by the weight of the arm, which will have a tendency to increase the gap G1 and reduce G2, will not cause pin 46*b* to bind against the most clockwise edge of notch 48 as viewed in FIG. 11. Optionally, with a different configuration of arm or different weight distribution, the two gaps may be adjusted so that they are substantially equal.

Optionally, instead of the stop block 66 contacting stop tube 64 to provide an initial course alignment of the pin of the locking mechanism with the notch, the set screw may be extended from the stop block 66, for example extended from the stop block 66 half its length, to provide the initial course alignment. With this set-up, set screw 70 can provide bidirectional adjustment. Optionally, the set screw can be set up to fully protrude at the beginning or at the end of its tune up length to allow adjustment in one direction only so that it is a unidirectional adjustment. Further, as would be understood, set screw 70 can be set to be anywhere in its tune-up length between stop block 66 and stop tube 64 when the pin is in the notch.

Thus in one embodiment, the patient support apparatus may include an adjustment mechanism configured for fine-tuned alignment of a first locking component with a second locking component after the first and second locking components are at least nearly aligned. The adjustment mechanism may be configured to provide unidirectional adjustment or bidirectional adjustment to the first locking component or the second locking component.

Referring again to FIG. 12, mounting assembly 22 is configured to provide a cable routing for a cable 80 through pivot connection 22*a* of mounting assembly 22. As best understood from FIGS. 12 and 1F, cable 80 extends from base 18 or frame 20 of apparatus 10 along mounting assembly 22 and through weldment 58 so that it can be redirected through pivot connection 22*a* of mounting assembly 22 to couple to electrical devices supported on arm 12 above pivot connection 22*a*.

In one embodiment, pivot connection 22*a* includes a cable pathway there through to allow a cable 80 to extend through the pivot connection. As will be more fully described below, pivot member 36 and stationary member 42 each include a slot extending there through, wherein the slots overlap over the operative range of motion of the pivot connection to thereby form the cable pathway there through.

As best seen in FIGS. 7 and 12A, stationary member 42 includes an elongated slot 82 through which cable 80 is passed from the inside of stationary member 42 to a corresponding elongated slot 84 formed in pivot member 36 (see also FIG. 12). Once redirected through pivot connection 22*a*, cable 80 extends upwardly along arm frame 30, for example along radial frame member 32, for connection to an electrical connector 86, which is mounted to frame member 32. Connector 86 provides an electrical connection to a second cable 88, which is extended along member 38 for connection with patient controls P2 provided on the inwardly facing side of arm 12. It should be understood that a single cable may be used instead, thus eliminating the need for connector 86.

Figure 13:
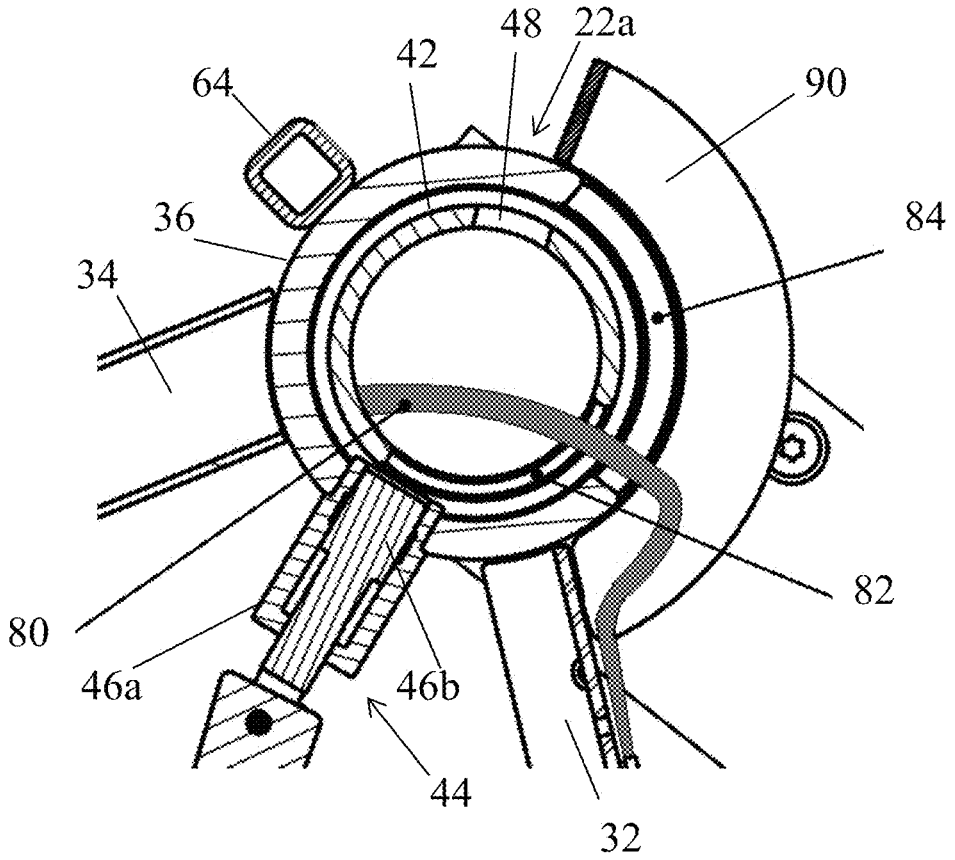
Figure 14:
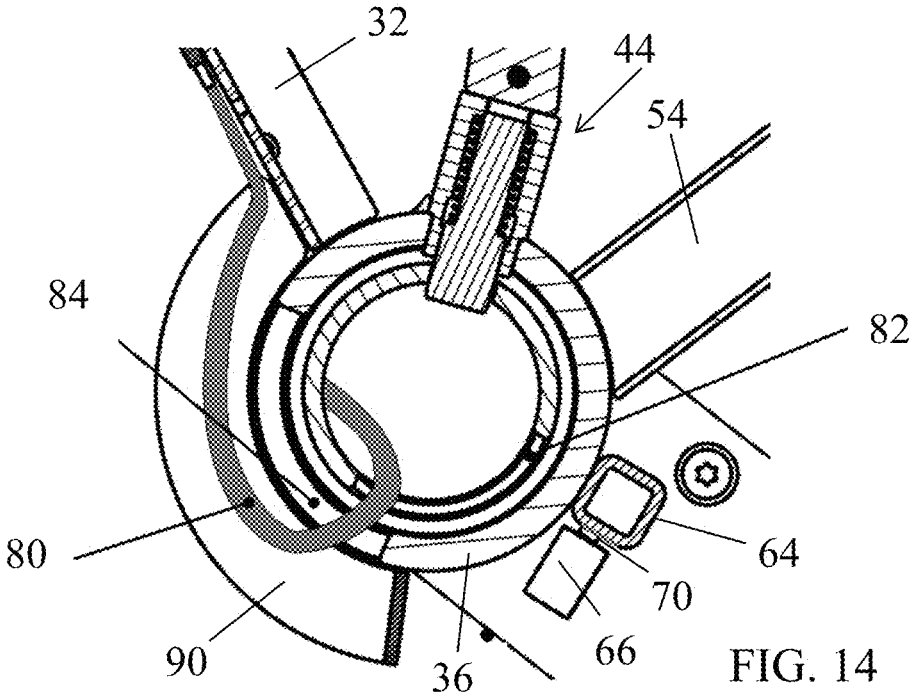
FIG. 14 is a similar view to FIG. 13 with the arm moved to its locked armrest position.
Figure 15:
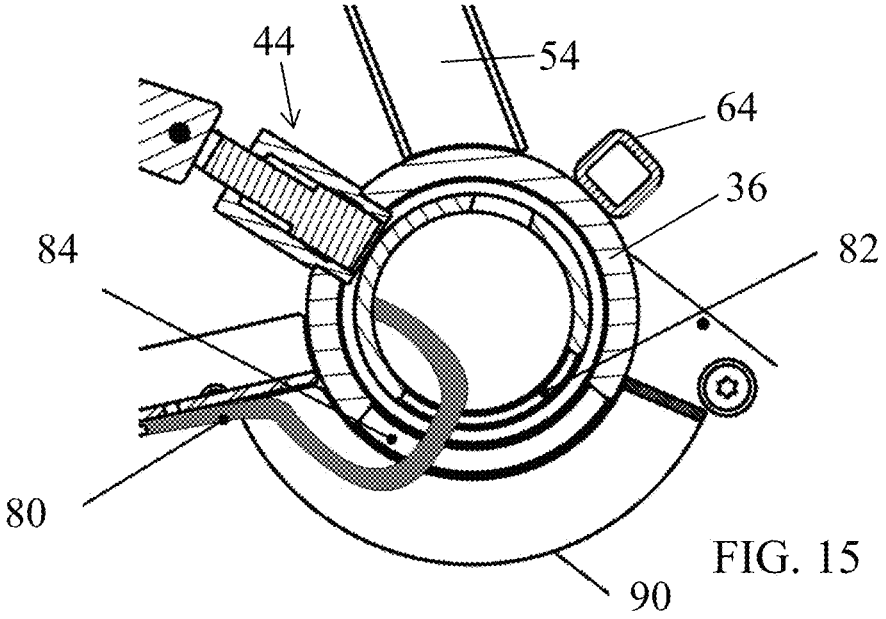
FIG. 15 is a similar view to FIG. 14 illustrating the arm moved to an unlocked position.

Referring to FIG. 13, when arm 12 is in its furthest back position, elongated slot 84 in pivot member 36 has a sufficient overlap with the elongated slot 82 of stationary member 42 to allow cable 80 to pass through the respective slots, and therefore through pivot member 36 and stationary member 42. As best seen in FIG. 14, when arm 12 is moved to its locked armrest position, elongated slot 84 in pivot member 36 also overlaps with the elongated slot in stationary member 42. Similarly, as seen in FIG. 15, when arm 12 is moved to an intermediate position between its locked armrest position and its fully furthest back position (FIG. 13), slot 84 in pivot member 36 also overlaps with the elongated slot 82 in stationary member 42. Further, the overlaps are sufficient to allow the cable to pass through without crimping or cinching the cable.

As best seen in FIGS. 12, 13-15, optionally, pivot connection 22*a* may include a shield or guard 90, which reduces the chance of cable 80 getting pinched between arm 32 and stop block 66. In the illustrated embodiment, guard 90 (FIG. 12) comprises an annular plate that is mounted, such as by welding, about pivot member 36, and which extends between stop tube 64 and frame member 32, and over stop block 66.

Optionally, as shown in FIG. 1, arms 12 may include covers 92. For example, covers 92 may be formed from a plastic, such as an impact modified plastic, such as an impact-modified nylon. One simple plastic includes ST801. Covers 92 are mounted about arm frame 30 and further may comprise a clamshell cover construction with a first half 92*b* of the cover forming and facing the patient side of arm 12 and a second half 92*a* of the cover forming the outside facing surface of arm 12. The two halves of the cover 92*a*, 92*b* may be joined by an upper channel shaped plastic member 94, which forms the curvature of the cushioned portion of the armrest. A suitable material for forming upper channel shaped plastic member 94 includes an ABS material. Further, the upper channel shaped plastic member may be overmolded with a soft cushioning material to form a cushion or pad at upper surface 12*b* of arm 12. The soft cushioning material is selected to provide more comfortable support to the patient. A suitable soft cushioning material includes a thermoplastic elastomer (noted below), a urethane foam, or other biocompatible materials. Biocompatible materials are not reactive with human skin and, therefore, do not cause any irritation or allergic reactions. Further, urethane foam is not usually affected by cleaning, and therefore is not damaged with repeated cleanings, which is common in medical facilities. As a result the cleaning process of arms 12 can be more efficient.

Other suitable cushioning materials for the arm rest cushion include gelatinous elastomeric materials. Suitable formulations of gelatinous elastomeric materials include gelatinous elastomeric materials formulated from a polymer and oil mixture with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated from a copolymer and oil with a weight ratio of oil to copolymers of approximately 2.6 to 1. Suitable copolymers may include Septon 4055 and 4044, which are available from Kuraray America, Inc., which has a place of business in Houston, Tex., or it may be other copolymers. If Septon 4055 and 4044 are both used, the weight ratio may be approximately 2.3 to 1 of Septon 4055 to Septon 4044. The oil may be mineral oil and one or more stabilizers may also be used. Additional ingredients—such as, but not limited to dye may also be added.

As noted, other suitable arm rest materials include a thermoplastic elastomer (TPE), including biocompatible TPEs, as well as latex-free elastomer materials (such as used on sports watches or exercise bands), self-skinning foam, wood, textured nylon, urethane-dipped metal, or fabric over foam. TPEs have the durability and elasticity of a thermosetting rubber, but can be injection molded. Also, as noted, some suitable TPE's are biocompatible and, further, can be selected to provide better scratch-resistance, e.g. based on the durometer and the surface finish.

Additionally, over molding the upper channel shaped plastic allows greater control over the curvature of the upper surface of arm 12, which as noted above, may be configured so that it follows a path that is generally parallel to the path followed by a point X (FIG. 1A) on backrest section 16 when the backrest section 16 is tilted relative to seat section 14. In this manner as backrest section 16 is raised or lowered between its seated and reclined positions, as described above, the distance D from a shoulder S of a person sitting in apparatus 10 to the upper surface 12*b* of the arm remains generally the same regardless of the reclined position of the chair. Optionally, the curvature of the upper surface 12*b* of arm 12 may be a smooth curve or have one or more curved regions, including curved regions with different curvatures, which have smooth transitions or non-smooth transitions between the curved regions. The curvature may be circular or non-circular. Alternately, the curvature of the upper surface 12*b* of arm 12 may have a combination of one or more linear segments and/or one or more curved segments, with smooth or non-smooth transitions between the segments. In one embodiment, the curvature of the upper surface 12*b* of arm 12 may be formed from a plurality of linear segments. Generally, the curvature may be such that the distance D from a shoulder S of a person sitting in apparatus 10 to the upper surface 12*b* of the arm remains generally the same regardless of the reclined position of the chair.

Figure 16:
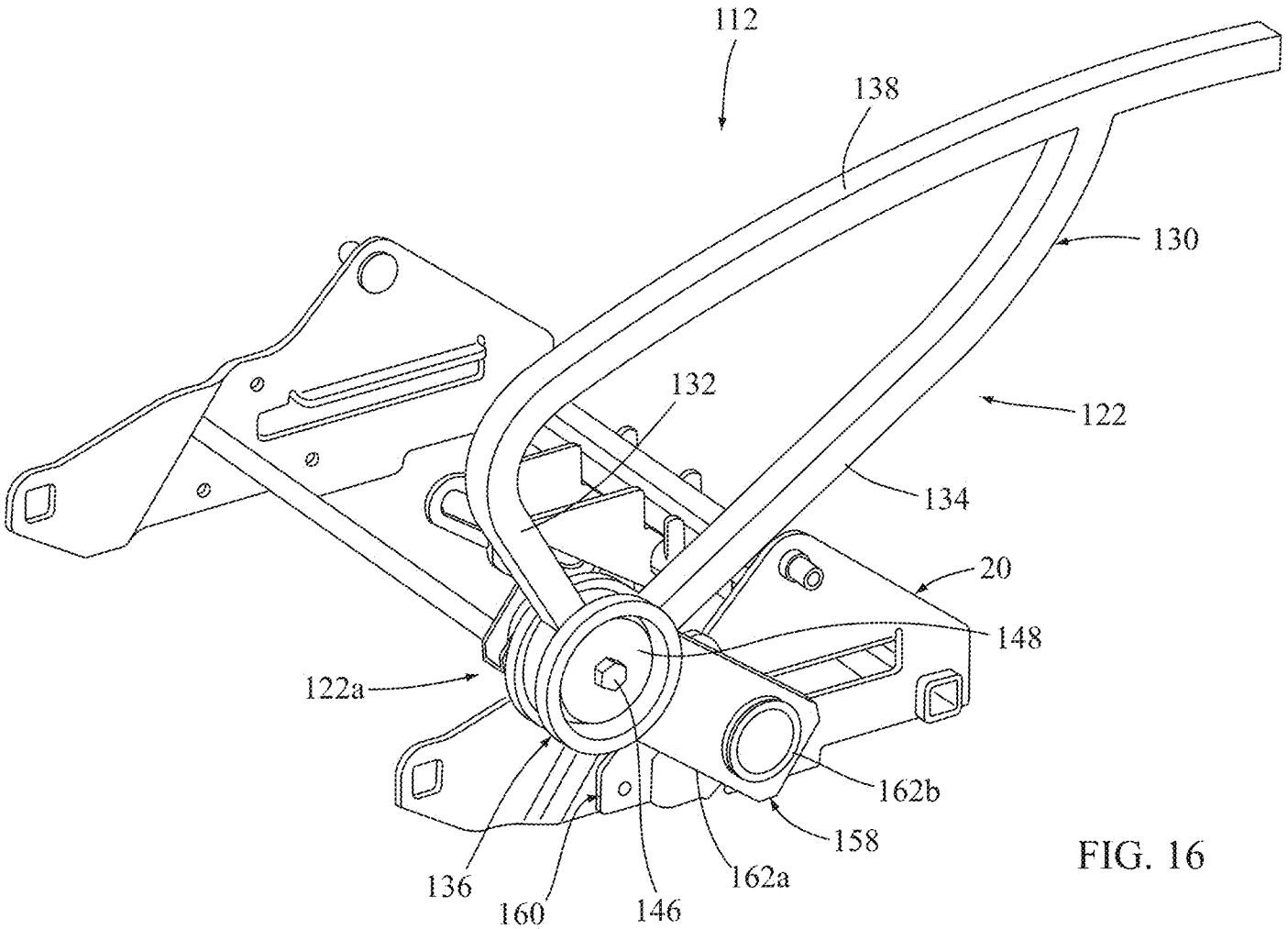
FIG. 16 is a perspective view of another embodiment of an arm mounting assembly incorporating a friction and compression joint.
Figure 17:
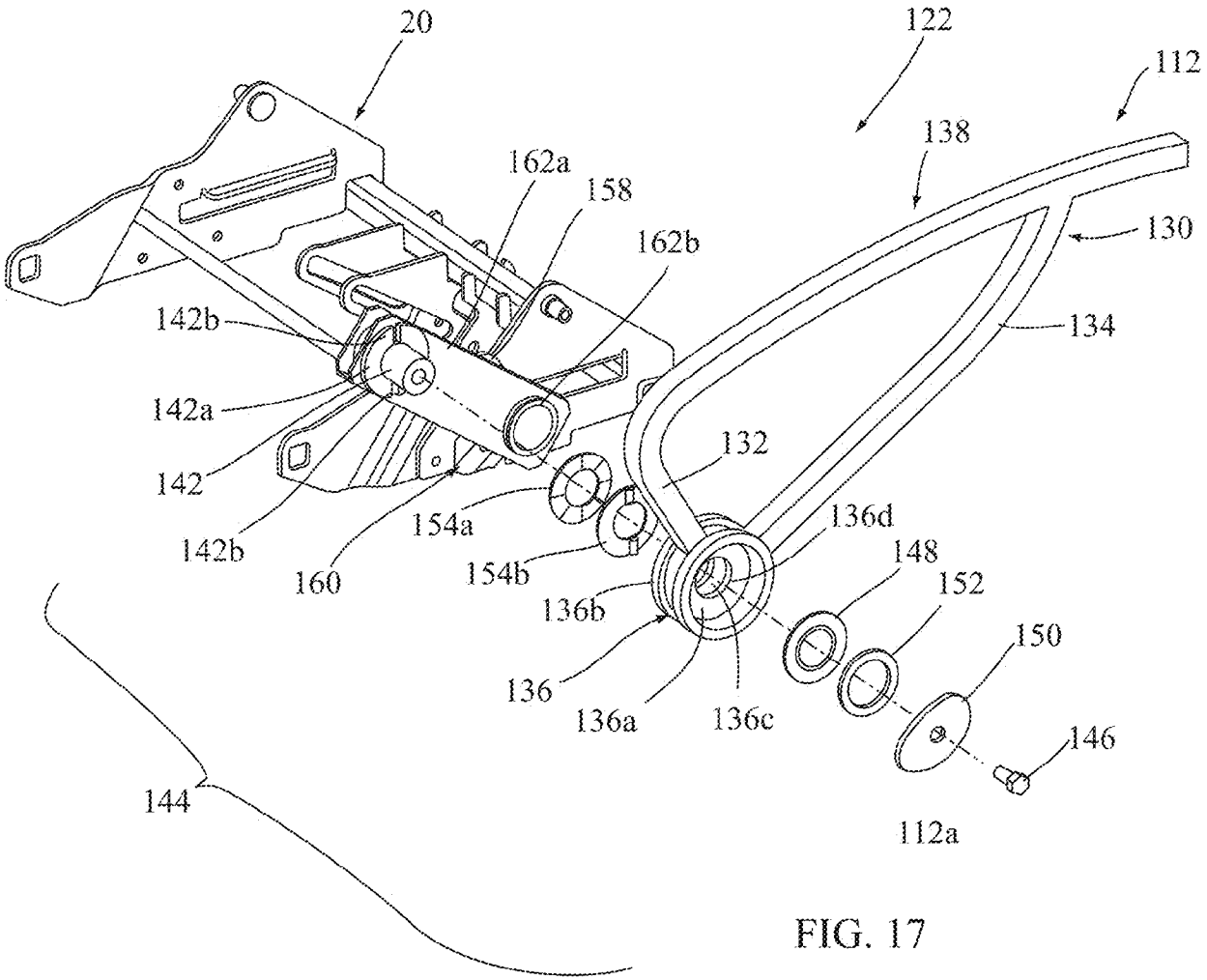
FIG. 17 is an exploded perspective view of the arm mounting assembly of FIG. 16.

Referring to FIGS. 16 and 17, the numerals 112 and 122 generally designate another embodiment of an arm and an arm mounting assembly, respectively, which may be suitable for use in the patient support apparatus described above, which incorporates a friction and compression joint to reduce the play or "slop" in the arm when the arm is mounted to a patient support apparatus. However, it should be understood that the friction and compression joint, which is described in more detail below, can be used on other types of arms or pivoting members, including the mounting arms of a side rail for a patient handling device, such as a hospital bed, stretcher, or cot. Further though not specifically illustrated herein, arm 112 or mounting assembly 122 may incorporate one or more of the features described above in reference arm 12 and mounting assembly 22, including the locking mechanism, the cable routing, and the cable guard, and also the fit-up mechanism, though as will be described below, arm mounting assembly 122 is configured to reduce play or "slop" in the arm when mounted to the patient support apparatus.

As best seen in FIG. 17, each arm 112 includes an arm frame 130 that has a generally triangular configuration and which is formed by two radial frame members 132 and 134 that are mounted at one end thereof to a pivot member 136. Pivot member 136 is formed by a cylindrical member, which mounts mounting assembly 122 to frame 20. Frame member 132 comprises a generally L-shaped member that is joined with the end of member 134, and which forms the upper support 138 of arm 112. Similar to the previous embodiment, support 138 includes a cushion (not shown) to form a cushioned arm rest. For further details of optional materials for forming the cushion, reference is made to the first embodiment.

Figure 18:
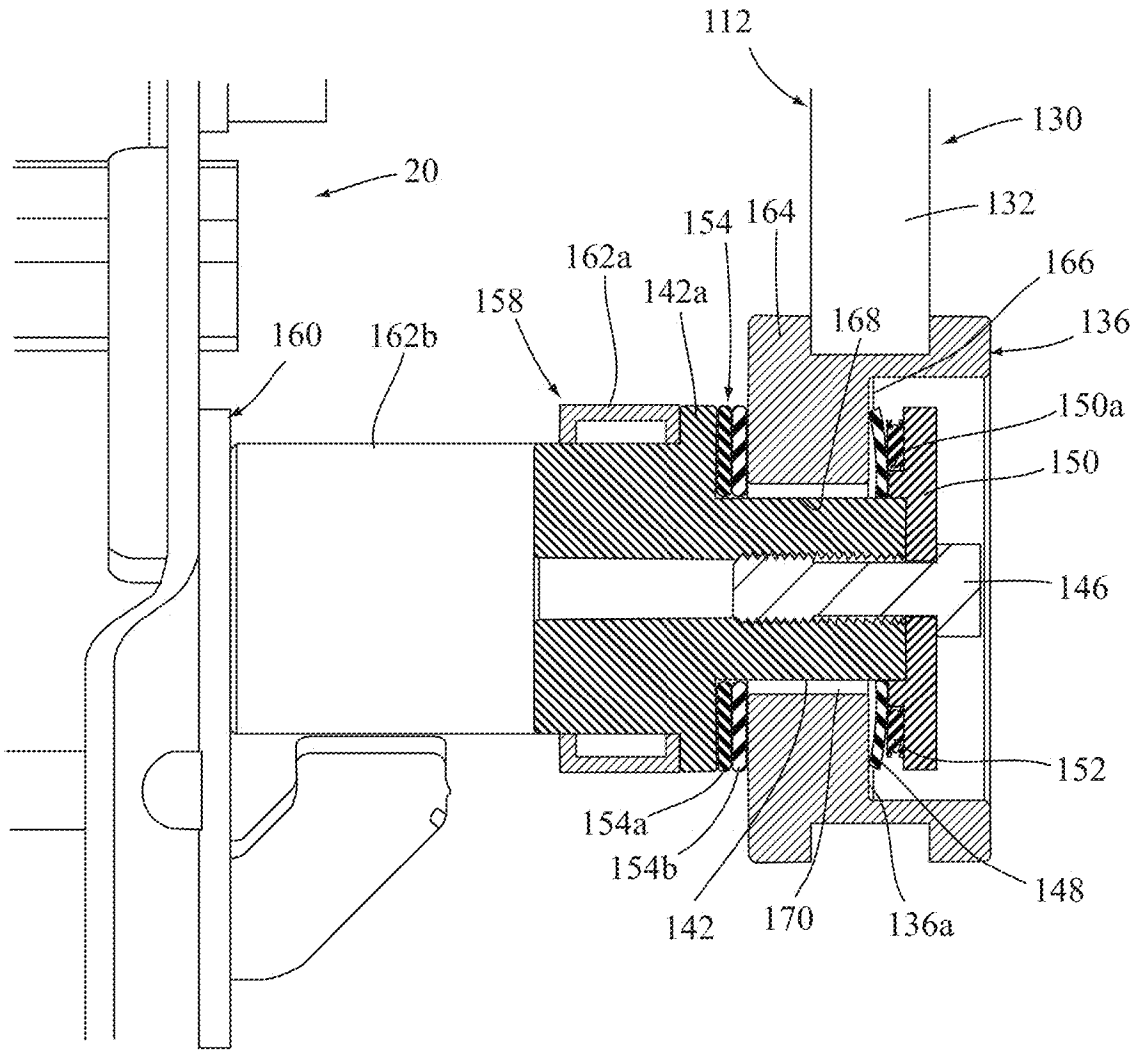
FIG. 18 is a cross-section view taken through the mounting assembly of FIG. 16.

Referring to FIGS. 17 and 18, pivot member 136 is rotatably mounted about a stationary member 142 (i.e., stationary relative to frame 20), which is also formed from a cylindrical member and which is fixedly mounted to frame 20. Thus, stationary member 142 forms a spindle tube about which pivot member 136 rotates to form a pivotal connection 122*a* (FIG. 16) for mounting assembly 122 about pivot axis 112*a* (FIG. 17).

In the illustrated embodiment, pivot member 136 is mounted to stationary member 142 with a friction and compression joint 144, which allows the arm mount assembly 122 to achieve a tight connection with the patient support apparatus to eliminate play or "slop", while allowing the arm 112 to freely move (when unlocked) about its pivot axis 112*a*.

Referring again to FIG. 17, arm mounting assembly 122 includes a weldment 158 and a bracket 160, which mounts mounting assembly 122 to frame 20. Stationary member 142 is mounted, such as by welding, to weldment 158 to thereby fix the position of stationary member 142 relative to frame 20. Weldment 158 includes a rectangular tubular member 162*a* and a cylindrical member 162*b*, which are joined together, for example, by welding. Cylindrical member 162*b* mounts weldment 158 to a bracket 160.

As noted above, pivot member 136 is mounted on stationary member 142 by a friction and compression joint 144. Friction and compression joint 144, also referred to as a "clutch pack", is formed by a fastener 146 that extends through pivot member 136 to threadingly engage stationary member 142. To maintain a tension on fastener 146 and, therefore, to create a compression force between pivot member 136 and stationary member 142, joint 144 includes one or more compression washers 148, such as a Belleville washer or wave disc spring, and a retaining washer 150 through which fastener 146 extends to compress washer 148 against the inner bearing surface 136*a* of pivot member 136.

In the illustrated embodiment, retaining washer 150 includes an annular ridge or shoulder 150*a*, which when compressed by fastener 146 applies the compression force to washer 148 inward of its outer perimeter. Shoulder 150*a* defines the stand-off distance or thickness of retaining washer 150 and determines the distance of travel washer 148 is compressed. Therefore, the thickness or stand-off distance of retaining washer directly impacts the amount compression washer 148 is compressed and, hence, the force the compression washer 148 generates. When compressed, for example, to the point where washer 148 is generally flat, washer 148 will generate the desired tension force on fastener 146 to act as a lock washer and maintain a tight connection between fastener 146 and member 142.

For example, suitable Belleville washers that allow free fall or a controlled fall of the arm while achieving a tight connection include the Belleville washer listed in Table 1 below and include Belleville washers with: An inside diameter (ID) in a range of about 0.505 inches to about 1.25 inches; an outside diameter (OD) in a range of about 1.5 inches to about 2.5 inches; a height in a range of about 0.104 inches to about 0.16 inches; a deflection in a range of about 0.017 inches to about 0.0460 inches; a deflected thickness of a range of about 0.055 inches to about 0.12 inches; and a working load in a range of about 195 lbs. to about 870 lbs.

TABLE 1

Belleville Washers

| ID | OD | Height | Deflects | Deflected Thickness | Working Load |
|---|---|---|---|---|---|
| 0.505 | 1.500 | 0.104 | 0.017 | 0.087 | 495 |
| 0.567 | 1.125 | 0.073 | 0.018 | 0.055 | 195 |
| 0.630 | 1.875 | 0.129 | 0.022 | 0.107 | 730 |
| 0.656 | 1.875 | 0.115 | 0.046 | 0.069 | 410 |
| 0.755 | 1.500 | 0.093 | 0.024 | 0.069 | 283 |
| 1.000 | 2.000 | 0.130 | 0.032 | 0.098 | 590 |
| 1.250 | 2.500 | 0.160 | 0.040 | 0.120 | 870 |

Suitable wave disc springs that allow a free fall or a controlled fall of the arm while achieving a tight connection include the wave disc springs listed in TABLE 2 below and include wave spring washers with: An inside diameter (ID) in a range of about 1.064 inches to about 1.594 inches; an outside diameter (OD) in a range of about 1.408 inches to about 2.088 inches; a height in a range of about 0.118 inches to about 0.157 inches; a deflection in a range of about 0.098 inches to about 0.141 inches; a deflected thickness of a range of about 0.016 inches to about 0.020 inches; and a working load in a range of about 99.2 lbs. to about 286.7 lbs.

TABLE 2

Wave Disc Springs

| ID | OD | Height | Deflects | Deflected Thickness | Working Load |
|---|---|---|---|---|---|
| 1.594 | 2.088 | 0.138 | 0.118 | 0.020 | 286.7 |
| 1.249 | 1.599 | 0.118 | 0.098 | 0.020 | 143.3 |
| 1.064 | 1.408 | 0.157 | 0.141 | 0.016 | 99.2 |

To assure that fastener 146 maintains its torque and does not come untightened when arm 112 is rotated about axis 112*a*, joint 144 also includes a low friction washer 152, such as a nylon or plastic washer or a thrust bearing washer, between retaining washer 150 and washer 148 to allow arm 112 and washer 148 to rotate together (along with disc 154*b* described below), but without loosening fastener 146.

In addition, joint 144 includes a thrust bearing 154 (FIG. 18) between stationary member 142 and pivot member 136. Thrust bearing 154 may be configured to provide smooth bearing surfaces generating only a low resistance so that pivot member 136 may pivot freely about stationary member 142 when unlocked and allow arm 112 to free fall about pivot axis 112*a*. Alternately, thrust bearing 154 may be configured to provide increased resistance so that pivot member 136 may pivot about stationary member 142 with a controlled fall (e.g. a slow fall and prevent free fall) of arm about pivot axis 112*a*. The term free fall is used to generally refer to when there is very little friction (or no friction) at the pivot connection such that an ordinary person would perceive that the arm is falling under gravity with little or no resistance. The term controlled fall is used to generally refer to when there is appreciable friction at the pivot connection so that an ordinary person would perceive that the arm's fall is slowed. As would be understood there is a continuous spectrum between free fall and controlled fall.

In a further embodiment, friction and compression joint 144 may be configured to fix or lock the arm rest in place (for example, by increasing the load on the fastener or by increasing the coefficient of friction of the friction discs) in applications where a fixed position is desired.

In the illustrated embodiment, thrust bearing 154 is formed by two discs 154*a*, 154*b*, for example bronze discs, which are fixedly mounted about pivot axis 112*a* to stationary member 142 and to pivot member 136, respectively. In this manner, when arm 112 is mounted on stationary member 142, discs 154*a*, 154*b* will be urged into engagement with each other by the compression force generated by washer 148 on fastener 146. The tension on fastener 146 is selected so that it provides a tight connection at joint 144 but so that arm 112 is free to move about axis 112*a*.

Optionally, the tension of fastener 146 may be increased by selecting a compression washer that generates a higher force to generate greater friction between the discs 154*a*, 154*b* so that they prevent free fall, but allow a controlled fall, of arm 112 about pivot axis 112*a*, but again do not limit the rotational movement of arm 112.

In the illustrated embodiment, stationary member 142 includes an annular bearing surface 142*a* at its base that includes two or more recesses or grooves 142*b*, which cooperate with corresponding projections or tabs formed on disc 154*a* to thereby rotatably couple disc 154*a* to stationary member 142. Similarly, the inwardly facing side 136*b* of pivot member 136 includes two or more recesses or grooves (not shown), which cooperate with corresponding projections or tabs formed on disc 154*b* to thereby rotatably couple disc 154*b* to pivot member 136.

Further in the illustrated embodiment, as best seen in FIG. 18, pivot member 136 is formed from a cylindrical member 164 with a recessed inner shoulder 166, which forms inner bearing surface 136*a* and includes a central opening 168 through which stationary member 142 extends for engagement by fastener 146. Located in opening 168 is an annular bearing 170, which provides a low friction mount for pivot member 136 on stationary member 142. As noted above, fastener 146 is threaded into stationary member 142, with washer 148 generating a tension force on fastener 146 to maintain a tight axial connection between pivot member 136 and stationary member 142. Further, as noted, the tension on fastener 146 is such that the friction generated between friction discs 154*a*, 154*b* will not stop the motion of arm 112 and, further, will still allow a controlled fall of arm 112 about axis 112*a*.

As noted above, multiple compression washers may be used. For example, multiple Belleville washers may be used either in series or in parallel. "In series" refers to when the Belleville washers are stacked so that their "apexes" are facing each other. In series, the force generated by the Belleville washers equals the force of a single washer, but the deflection is the total deflection of the two washers. "In parallel" refers to washers that are nested. In parallel, the deflection is the deflection of one washer, but the force is doubled. Therefore, when using Belleville washers in series the same force can be achieved with twice the deflection, i.e. compression, which can be used to double the tolerance in the stand-off distance, which makes the assembly process less exacting as well.

Figure 19:
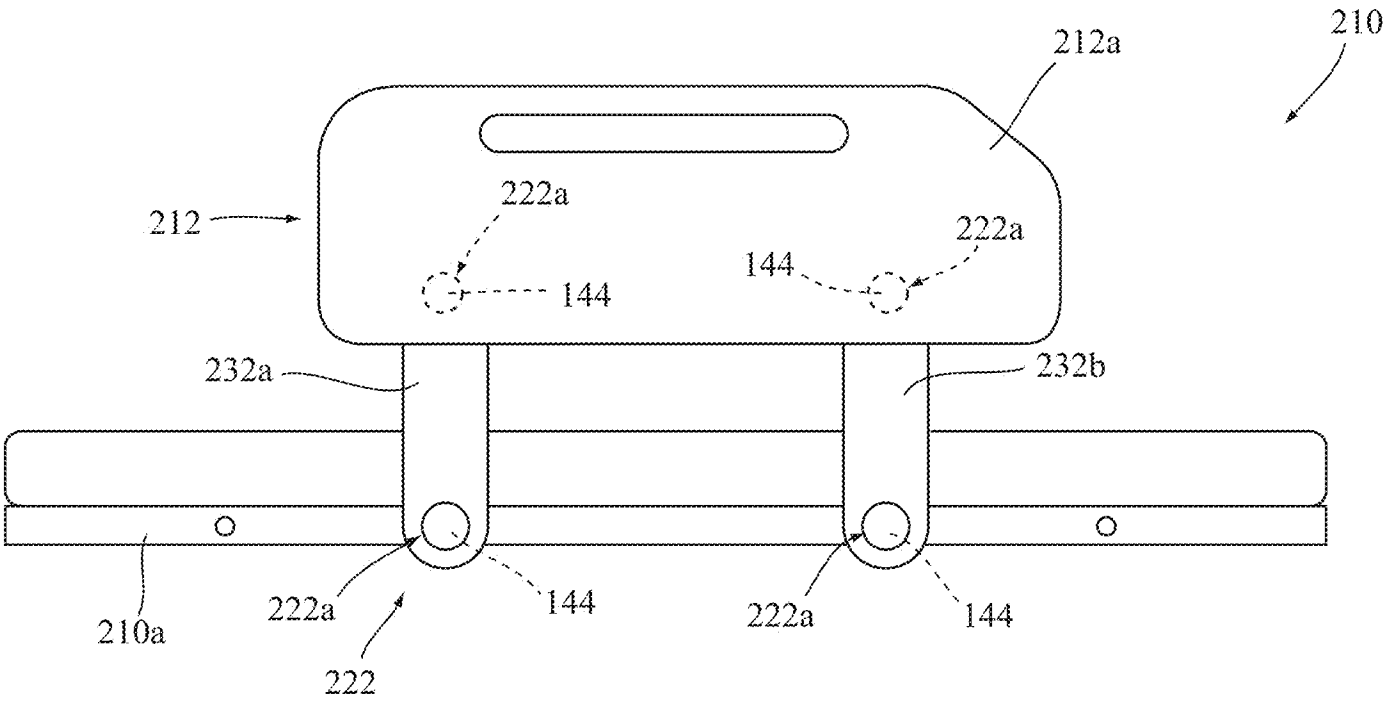
FIG. 19 is an elevation view of another embodiment of an arm mounting assembly of a side rail incorporating the friction and compression joint of FIGS. 16-18, with the side rail shown in a raised position.
Figure 20:
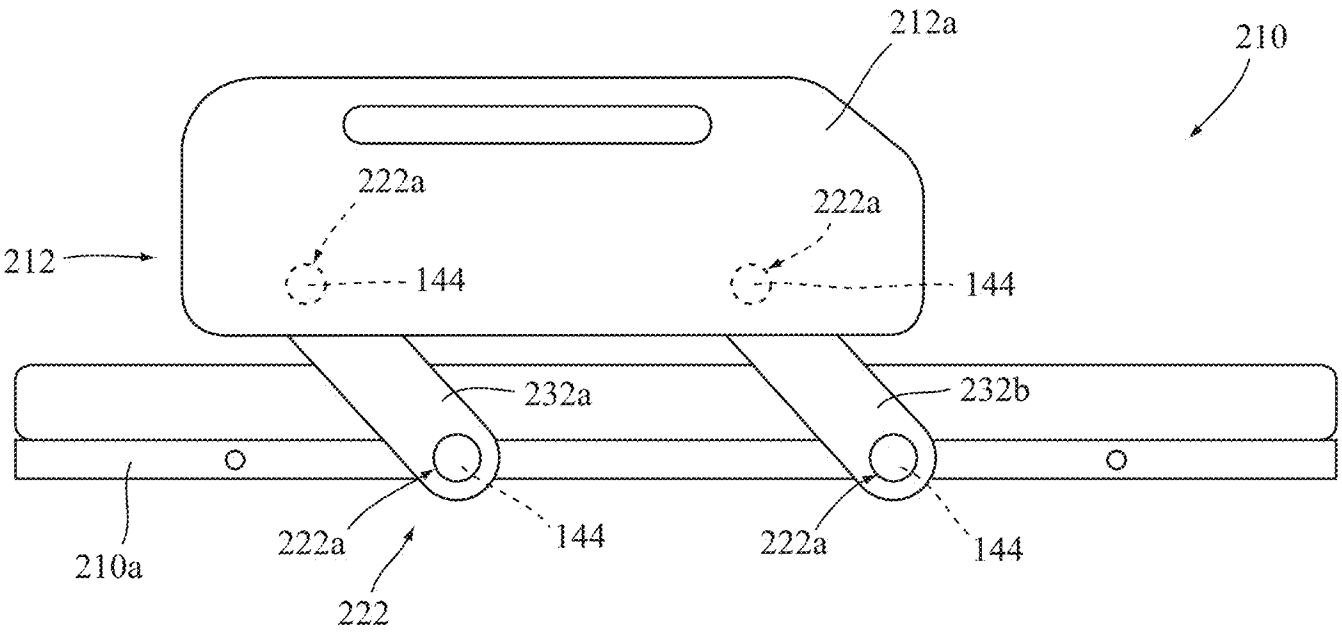
FIG. 20 is another elevation view of the arm mounting assembly of FIG. 19 with the side rail shown in an intermediate position.
Figure 21:
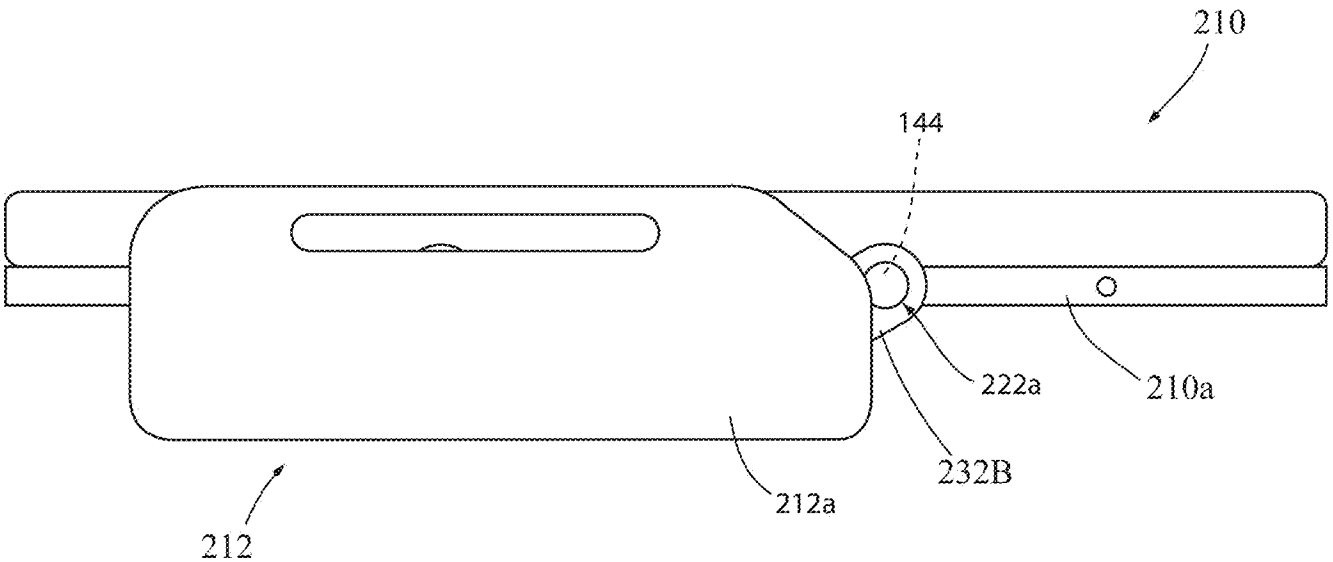
FIG. 21 is another elevation view of the arm mounting assembly of FIG. 19 with the side rail shown in a lowered position.

Referring to FIGS. 19-21, as described above, the friction and compression 144 may be incorporated into other arm assemblies, such as a mounting arm assembly 222 of a side rail. For example, the side rail may comprise a side rail 212 of a patient support apparatus 210, such as a bed, a stretcher, or a cot.

In the illustrated embodiment, mounting arm assembly 222 includes a pair of arms 232*a* and 232*b*, which mount side rail body 212*a* of side rail 212 to the frame 210*a* of the patient support apparatus 210. Arms 232*a*, 232*b* are pivotally mounted at their upper ends and lower ends by pivot connections 222*a*, respectively, to side rail body 212*a* and frame 210 a form a 4-bar linkage so that side rail 212 can be moved between a raised position, such as shown in FIG. 19, to an intermediate position, such as shown in FIG. 20, and to a lowered position, such as shown in FIG. 21.

Optionally, each of the pivot connections 222*a* may incorporate the friction and compression joint 144 described above in reference to arm 112. For example, frame 210*a* may include a pair of stationary members, each similar to stationary member 142, and the side rail body 212*a* may include a pair of stationary members, each similar to stationary member 142. The upper and lower ends of arms 212*a*, 212*b* (as viewed in FIG. 19) may each include a pivot member, similar to pivot member 136, which pivotally mount the arms to the stationary members to thereby form the 4-bar linkage. Further, as noted, pivot connection 222*a* may incorporate the friction and compression joint 144 to urge the pivot members into tight engagement with the respective stationary members to allow free (or controlled) fall of the arms while reducing play or slop in the respective pivot connections. Optionally, the force applied by the compression washers may be increased and/or the coefficient of friction of the friction discs may be increased so as to prevent free fall of the side rail and, instead, soften the fall of the side rail by generating sufficient friction between the thrust bearings to slow the free fall and provide a controlled fall of the arms. Further as noted above, friction and compression joint 144 may be configured to lock the sider rail in place (for example, by increasing the load on the fastener or by increasing the coefficient of friction of the friction discs) in applications where a free fall or even a controlled fall of the side rail is not desired and, instead, a fixed position is desired. It should be understood that an additional locking mechanism (in addition to the friction disc mechanism) may be added.

For further details of suitable locking mechanisms and other components or features that may be incorporated into side rail 212, reference is made herein to U.S. Pat. Nos. 6,938,289; 7,690,059; 7,805,784; 7,962,981; 7,861,334; 9,126,571; 8,393,026; 8,701,229; 7,712,166; 7,412,734; 7,971,291; and 7,784,125, which are commonly assigned to Stryker Corporation of Kalamazoo, Mich. and which are hereby incorporated by reference in their entireties herein.

While several embodiments have been shown and described, the above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert but which can be used independently and/or combined with other features. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A patient support apparatus comprising:

a seat section;

a backrest section, the backrest section movable relative to the seat section; and an arm supported relative to the seat section, and the arm being adapted to move between a first position adjacent the seat section and decoupled from said backrest section for use as an arm rest for a person sitting on the patient support apparatus independent of the position of the backrest section to a raised second position adjacent the backrest section, and the arm and the backrest section being releasably coupled together when the arm is in the raised second position wherein the arm moves with the backrest section.

2. The patient support apparatus according to claim 1, wherein the arm and the backrest section are selectively releasably coupled together when the arm is in the raised second position.

3. The patient support apparatus according to claim 1, wherein the backrest section comprises a stop, the stop releasably coupling the arm to the backrest section.

4. The patient support apparatus according to claim 1, further comprising a chassis frame, the chassis frame supporting the seat section and the backrest section, and the arm being pivotally mounted to the chassis frame or the seat section.

5. The patient support apparatus according to claim 4, further comprising a mounting member mounted to the chassis frame, the mounting member being stationary relative to the chassis frame, and the arm being rotatably mounted about the mounting member to thereby pivotally mount the arm to the chassis frame.

6. The patient support apparatus according to claim 1, further comprising a locking mechanism for locking the arm in the first position.

7. The patient support apparatus according to claim 6, wherein the locking mechanism includes a plunger.

8. The patient support apparatus according to claim 7, further comprising a chassis frame supporting the seat section, the chassis frame including a mounting member mounted to the chassis frame, the mounting member being stationary relative to the chassis frame, the arm rotatably mounted about the mounting member to thereby pivotally mount the arm to the chassis frame, and wherein the plunger selectively engages the mounting member to thereby lock the arm in at least the first position.

9. The patient support apparatus according to claim 8, wherein the arm includes an arm frame, the arm frame including a pivot member, the pivot member of the arm frame rotatably mounting the arm about the mounting member of the chassis frame, and the plunger mounted in the pivot member of the arm frame.

10. The patient support apparatus according to claim 9, further comprising a release mechanism, such as a handle, the handle coupled to the plunger to selectively actuate the locking mechanism.

11. The patient support apparatus according to claim 10, wherein the handle is mounted to the arm frame.

12. The patient support apparatus according to claim 1, wherein the backrest section is configured to tilt relative to the seat section between a first angle and a second angle, wherein the raised second position comprises a first raised unlocked position of a plurality of raised unlocked positions generally aligning the arm with the backrest section when the backrest section is at the first angle, further comprising a second raised unlocked position of the plurality of raised unlocked positions generally aligning the arm with the backrest section when the backrest section is at the second angle.

13. The patient support apparatus according to claim 12, wherein the arm and the backrest section are selectively releasably coupled together when the arm is in the first raised unlocked position and when the arm is in the second raised unlocked position.

14. A patient support apparatus comprises:

a seat section;

a pivotal backrest section wherein the backrest section can tilt relative to the seat section between a seated position and a reclined position;

a chassis frame supporting the seat section and the backrest section; and an arm, the arm being mounted independent of the seat section and directly pivotally mounted about a horizontal axis to the chassis frame, the arm having a curved upper surface forming an arm rest, the curved upper surface being generally parallel to a path formed by a point on the backrest section when the backrest section is tilted between the seated position and the reclined position wherein the distance of a shoulder of a person sitting in the patient support apparatus to the curved upper surface of the arm remains generally constant regardless of the position of the backrest section.

15. The patient support apparatus according to claim 14, wherein the curved upper surface includes one or more curved regions.

16. The patient support apparatus according to claim 14, wherein the arm is pivotally mounted to the chassis frame or the seat section.

17. The patient support apparatus according to claim 16, wherein the seat section includes a cushion, and wherein the arm is pivotally mounted to the chassis frame about a pivot axis located below the cushion.

18. The patient support apparatus according to claim 14, wherein the seat section is pivotally mounted to the chassis frame.

19. The patient support apparatus according to claim 14, wherein the arm includes a cushioning material to form the arm rest, the cushioning material comprising a biocompatible material.

20. A patient support apparatus comprising:

a seat section;

a pivotal backrest section;

a chassis frame supporting the seat section and the backrest section, the backrest section and the seat section supported to tilt relative to the chassis frame;

a base adapted to support the chassis frame on and to raise the chassis frame relative a floor surface; and an arm directly pivotally mounted about a horizontal axis to the chassis frame and being independent of the seat section, the arm having an upper surface forming an arm rest, the upper surface having an orientation relative to the floor surface, and the orientation of the arm rest remaining generally constant when the backrest section is tilted, when the seat section is tilted, or when the chassis frame is raised relative to the floor surface so as to provide a stable surface for a person seated in the apparatus and when the person is exiting the apparatus.

21. The patient support apparatus according to claim 20, wherein the upper surface includes one or more curved regions.

22. The patient support apparatus according to claim 20, wherein the arm is mounted to the chassis frame.

23. The patient support apparatus according to claim 20, wherein the arm includes a cushioning material to form the upper surface, the cushioning material comprising a biocompatible material.

24. A method of using an arm on a recliner chair, the recliner chair having a seat section and a tiltable backrest section, said method comprising:

pivotally mounting the arm to the recliner chair;

moving the arm to an armrest position adjacent the seat section where the arm is decoupled from the backrest section;

selectively locking or unlocking the arm in the armrest position;

when unlocked from the armrest position, selectively pivoting the arm to a raised position adjacent the backrest section; and when the backrest section is tilted away from the armrest position and adjacent the backrest section, releasable coupling the arm to the backrest section wherein the arm moves with the backrest section.

* * * * *